US007581339B2

(12) United States Patent
Mizoroke et al.

(10) Patent No.: US 7,581,339 B2
(45) Date of Patent: Sep. 1, 2009

(54) SNOW REMOVING MACHINE

(75) Inventors: Tsutomu Mizoroke, Wako (JP); Toshiaki Kawakami, Wako (JP); Naotoshi Ono, Wako (JP)

(73) Assignee: Honda Motor Co., Ltd. (JP)

( * ) Notice: Subject to any disclaimer, the term of this patent is extended or adjusted under 35 U.S.C. 154(b) by 517 days.

(21) Appl. No.: 11/286,371

(22) Filed: Nov. 23, 2005

(65) Prior Publication Data

US 2006/0123667 A1 Jun. 15, 2006

(30) Foreign Application Priority Data

Nov. 24, 2004 (JP) ..... 2004-339518

(51) Int. Cl.
*E01H 5/04* (2006.01)

(52) U.S. Cl. ..... 37/234; 37/244

(58) Field of Classification Search ..... 37/213, 37/234, 247, 248, 261, 270, 244, 245; 180/9.46, 180/9.22, 9.44, 9.38, 19.1; 280/6.15
See application file for complete search history.

(56) References Cited

U.S. PATENT DOCUMENTS

| | | | | | |
|---|---|---|---|---|---|
| 2,440,166 | A * | 4/1948 | Bourne et al. | ..... | 37/271 |
| 3,055,127 | A | 9/1962 | Williamson | ..... | 37/43 |
| 3,178,838 | A * | 4/1965 | Brown | ..... | 37/363 |
| 3,213,552 | A | 10/1965 | Vanvick | ..... | 37/43 |
| 4,570,366 | A * | 2/1986 | Yost | ..... | 37/232 |
| 4,718,537 | A * | 1/1988 | Miller | ..... | 198/513 |
| 4,756,101 | A * | 7/1988 | Friberg et al. | ..... | 37/244 |
| 4,836,320 | A * | 6/1989 | Sundin | ..... | 180/19.1 |
| 5,020,250 | A * | 6/1991 | Fujii et al. | ..... | 37/257 |
| 5,127,174 | A | 7/1992 | Takeshita | ..... | 37/250 |
| 5,353,529 | A * | 10/1994 | McCullough | ..... | 37/142.5 |
| 5,438,770 | A | 8/1995 | Miller | ..... | 37/227 |
| 5,806,213 | A * | 9/1998 | Doornek et al. | ..... | 37/231 |
| 6,324,775 | B1 * | 12/2001 | Harnois et al. | ..... | 37/266 |
| 6,327,799 | B1 * | 12/2001 | Hanafusa et al. | ..... | 37/257 |
| 6,742,290 | B2 * | 6/2004 | Hanafusa | ..... | 37/248 |
| 6,948,577 | B2 * | 9/2005 | Wakitani et al. | ..... | 180/65.1 |

FOREIGN PATENT DOCUMENTS

| | | |
|---|---|---|
| EP | 1006240 | 6/2000 |
| EP | 1277886 | 1/2003 |
| JP | 61030085 | 7/1986 |
| JP | 63194927 | 12/1988 |
| JP | 64031418 | 2/1989 |

* cited by examiner

*Primary Examiner*—Thomas B Will
*Assistant Examiner*—Jamie L McGowan
(74) *Attorney, Agent, or Firm*—Adams & Wilks

(57) ABSTRACT

A snow removing machine has a frame, a pair of transporting devices mounted on the frame for transporting the snow removing machine on a ground surface, an auger housing having an auger housed therein and mounted on the frame for undergoing rolling movement, a rolling drive mechanism coupled to the auger housing for providing rolling movement of the auger housing relative to the frame, and a turning mechanism operable to turn the snow removing machine in a preselected direction. In response to operation of the turning mechanism, a control section performs a control operation to drive the transporting devices to thereby turn the snow removing machine in the preselected direction and performs a control operation of the rolling drive mechanism to provide rolling movement of the auger housing relative to the frame.

18 Claims, 20 Drawing Sheets

SNOW REMOVING MACHINE

FIELD OF THE INVENTION

The present invention relates to self-propelled snow removing machines including left and right running devices and an auger.

BACKGROUND OF THE INVENTION.

In many snow removing machines provided with an auger, there is employed a technique in accordance with which the auger is varied in height in accordance with conditions of snow removal work. When the snow removing machine should travel, it can do so more efficiently with the lower end surface of the auger positioned higher. When, on the other hand, the snow removing machine should remove snow, it can do so more efficiently with the lower surface of the auger positioned lower. Further, in many cases, the height of the auger is adjusted in accordance with road surface irregularity or unevenness. Where the auger height is adjusted through manual input operation by a human operator, the input operation tends to be a great load on the human operator.

Auger-type snow removing machines, constructed to move the lower end surface of the auger in an upward/downward direction in order to reduce a load on a human operator, are known, for example, from Japanese Patent Post-Exam Publication No. SHO-61-30085 and Japanese Utility Model Laid-Open Publication Nos. SHO-63-194927 and SHO-64-31418.

FIG. 20 is a side view showing the conventional auger-type snow removing machine disclosed in SHO-61-30085. The auger-type snow removing machine 200 of FIG. 20 is a self-propelled vehicle, in which a vehicle body frame 204 having an engine 203 mounted thereon is vertically pivotably connected at its rear end portion to a running-device frame 202 having left and right running devices 201 mounted thereon. Further, in the disclosed auger-type snow removing machine 200, an auger housing 205 and blower case 206 are rollably connected to a front end portion of the vehicle body frame 204.

The left and right running devices 201 are in the form of left and right crawlers. The auger housing 205 houses an auger 207, and the blower case 206 houses a blower 208. The snow removing machine 200 can travel with output power of the engine 203 transmitted via a transmission device 209 to the running devices 201. Switching between forward and rearward running and between left and right turning of the running devices 201 can be effected by the human operator manipulating operation levers 211 etc. Snow can be removed by the output power of the engine 203 being transmitted via a belt transmission mechanism 213 to the auger 207 and blower 208.

Front portion of the vehicle body frame 204 can be moved in the upward/downward direction via an auger housing elevator mechanism 222 by the human operator pivoting an auger-housing-posture manipulating lever 221 in a forward/rearward direction, in response to which the auger housing 205 can be moved in the upward/downward direction.

Further, the auger housing 205 and blower case 206 can be rolled via a rolling drive mechanism 223 by the human operator pivoting the auger-housing-posture manipulating lever 221 in a leftward/rightward direction.

In general, when the snow removing machine 200 is to be turned in a desired direction, one of the running devices 201, which is located inwardly of the other as viewed in the turning direction, is slowed down. However, a coefficient of friction between a snow surface and the running devices 201 is smaller than a coefficient of friction between an ordinary road surface and the running devices 201. Furthermore, even when one of the running devices 201 (hereinafter "inner running device") which is located inwardly of the other (hereinafter "outer running device") as viewed in the turning direction is slowed down as the snow removing machine 200 is turned during low-speed travel, e.g. immediately before stoppage of the machine 200, there can be created only an extremely small difference in traveling speed between the inner running device 201 and the outer running device 201.

Particularly, the running devices 201, which are in the form of crawlers, present a great ground contact capability and great driving force inherent to the crawlers. If the speed difference between the left and right crawlers is small, the tractive force of the inner crawler 201 is not so great as compared to the tractive force of the outer crawler; namely, the speed difference between the inner and outer crawlers can not increase as required. Thus, it tends to be difficult to attain a desired turning radius when the human operator performs operation for switching from the straight travel to the turning travel, and further improvements must be made in order to allow the snow removing machine 200 to smoothly switch from the straight travel to the turning travel.

SUMMARY OF THE INVENTION

In view of the foregoing prior art problems, it is an object of the present invention to provide a technique which can effectively improve turning performance of a snow removing apparatus equipped with left and right running devices and an auger.

In order to accomplish the above-mentioned object, the present invention provides an improved snow removing machine, which comprises: left and right running devices mounted on a running-device frame; an auger housing having an auger housed therein and rollably mounted on the running-device frame; a rolling drive mechanism for rolling the auger housing; a turning operator operable to turn the snow removing machine; and a control section for, in response to operation of the turning operator, not only performing control to drive the left and right running devices to thereby turn the snow removing machine in a desired turning direction. Also, in response to the operation of the turning operator, the control section issues a drive instruction to the rolling drive mechanism to roll the auger housing in an inward direction, as viewed in the turning direction of the snow removing machine, such that a portion of one of side edges of the auger housing, located inwardly of the other side edge as viewed in the turning direction, is brought into contact with the ground surface.

By the control section issuing a drive instruction to the rolling drive mechanism in response to human operator's operation of the turning operator, the auger housing can be rolled in the inward direction, as viewed in the turning direction of the snow removing machine. In this way, the portion of one of the side edges of the auger housing (i.e., "inner side edge"), located inwardly of the other side edge as viewed in the turning direction, is brought into contact with the ground surface, e.g. bite into a snow surface on the ground.

With the "inner" side edge of the auger housing caused to contact the ground surface, there is produced a new traveling resistance against the inner side edge, and thus, the machine can turn about the portion of the ground-contacting inner side edge as a pivot center.

Thus, as the human operator operates the turning operator, not only one of the running devices, located inwardly of the other running device as viewed in the turning direction, can be slowed down but also the auger housing can be rolled in such a manner as to cause the inner side edge to contact the ground surface, which can thereby enhance the turning performance of the snow removing machine. Therefore, by the human operator operating the turning operator, the snow removing machine can be smoothly switched from straight travel to turning travel. As a result, the snow removing machine of the invention can be highly maneuverable and usable with ease and, therefore, can efficiently perform snow removal work even in small working areas.

The snow removing machine of the invention may further comprise left and right operating handles extending from a rear portion of the running-device frame, and the turning operator may comprise left and right turning operators, such as left and right operation levers operable by the hands of a human operator holding the left and right operating handles, or left and right push-button switches provided between the left and right operating handles at positions within ranges operable by the hands of the human operator holding the left and right operating handles. Thus, the human operator can also operate the left and right turning operator members with the same hands holding the operating handles to manipulate the snow removing machine. Therefore, it is not necessary to rehold or release or let go of any of the left and right operating handles each time the human operator performs operation for turning the snow removing machine to the left or right. As a consequence, the present invention can enhance the operability of the snow removing machine and allows the human operator to turn the machine with ease. With such an enhanced turning operability and turning capability of the snow removing machine, the overall performance of the machine can be significantly improved. Further, because only the operation levers or push buttons have to be provided near the left and right operating handles for purposes of turning the machine, the present invention can reduce the number of components necessary to implement the turning operator and thereby simplify the construction of the turning operator.

The snow removing machine may further comprise an auger-housing-posture manipulating lever for operating the rolling drive mechanism to roll the auger housing in accordance with a snow surface during snow removal work using the auger. In this case, the auger-housing-posture manipulating lever may be caused to also function as the turning operator. Thus, it is possible to dispense with the separate or dedicated turning operator. Even though the snow removing machine has no dedicated turning operator, the human operator can use the auger-housing-posture manipulating lever to readily perform operation for turning the machine. Thus, the present invention can achieve an enhanced turning operability, sufficient turning performance and hence enhanced overall performance of the snow removing machine. Since the number of necessary operator members can be minimized, such inventive arrangements can be suitably applicable to snow removing machines that have to be small in size or have other spatial limitations. Further, because the number of necessary component parts can be reduced, it is possible to reduce the manufacturing cost of the snow removing machine.

BRIEF DESCRIPTION OF THE DRAWINGS

Certain preferred embodiments of the present invention will hereinafter be described in detail, by way of example only, with reference to the accompanying drawings, in which.

DETAILED DESCRIPTION OF THE PREFERRED EMBODIMENTS

It should be noted that the terms "front", "rear", "left", "right", "upper", "lower", etc. represent various directions as viewed by a human operator operating the snow removing machine.

Figure 1:
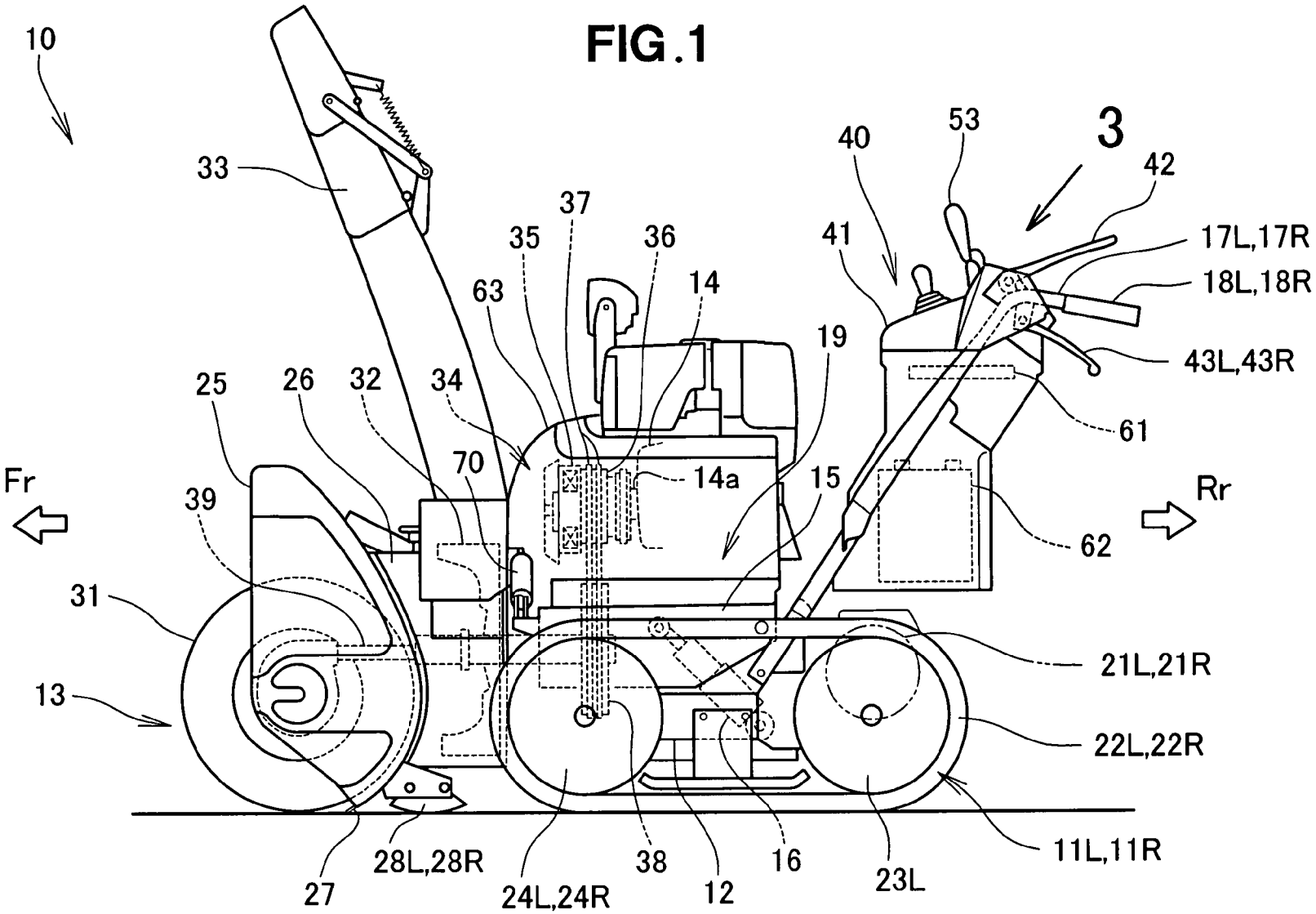
FIG. 1 is a side view showing a snow removing machine in accordance with a first embodiment of the present invention.

FIG. 1 is a side view showing a snow removing machine in accordance with a first embodiment of the present invention, the snow removing machine 10 of FIG. 1 is a self-propelled vehicle, in which a snow removal work section 13 and an engine 14 for driving the snow removal work section 13 are mounted on a vehicle body frame (second frame) 15, and in which the vehicle body frame 15 is vertically pivotably connected at its rear end portion to a running-device frame (first frame) 12 having left and right running (transporting) devices 11L and 11R mounted thereon. Further, in the snow removing machine 10, a front portion of the vehicle body frame 15 can be moved in an upward/downward direction (i.e., vertically pivoted) via an auger housing elevator mechanism 16. Left and right operating handles 17L and 17R extend upwardly and rearwardly from a rear portion of the running-device frame 12, and grips 18L and 18R are fixed to the respective digital ends of the left and right operating handles 17L and 17R.

The running-device frame 12 and vehicle body frame 15 together constitute a machine body 19. On the running-device frame 12, there are also mounted left and right electric motors 21L and 21R for driving the left and right running devices 11L and 11R. The left and right running devices 11L and 11R include left and right crawler belts 22L and 22R, left and right driving wheels 23L and 23R disposed on rear portions of the devices 11L and 11R, and left and right driven wheels 24L and 24R disposed on front portions of the devices 11L and 11R.

The left crawler belt 22L can be driven by the left electric motor 21L via the left driving wheel 23L, while the right crawler belt 22R can be driven by the right electric motor 21R via the right driving wheel 23R.

The snow removal work section 13 includes an auger housing 25, a blower case formed integrally with the rear surface of the auger housing 25, an auger 31 housed in the auger housing 25, a blower housed in the blower case 26, and a shooter 33. On rear lower end portions of the auger housing 25, there are mounted a scraper 27 and left and right sleds 28L and 28R.

The engine 14 is a snow-removing drive source for driving the snow removal work section 13 via a snow-removing-power transmission mechanism 34. The snow-removing-power transmission mechanism 34 includes a driving pulley 36 connected via an electromagnetic clutch 35 to a crank shaft 14*a* of the engine 14, a transmission belt 37, and a rotation shaft 39 having a driven pulley 38 mounted thereon.

The output power of the engine 14 is transmitted to the auger 31 and blower 32 via the crankshaft 14*a*, electromagnetic clutch 35, driving pulley 36, transmission belt 37, driven pulley 38 and rotation shaft 39. Snow gathered by the auger 31 can be thrown far away from the machine 10 by the blower 32 through the shooter 33.

Figure 4:
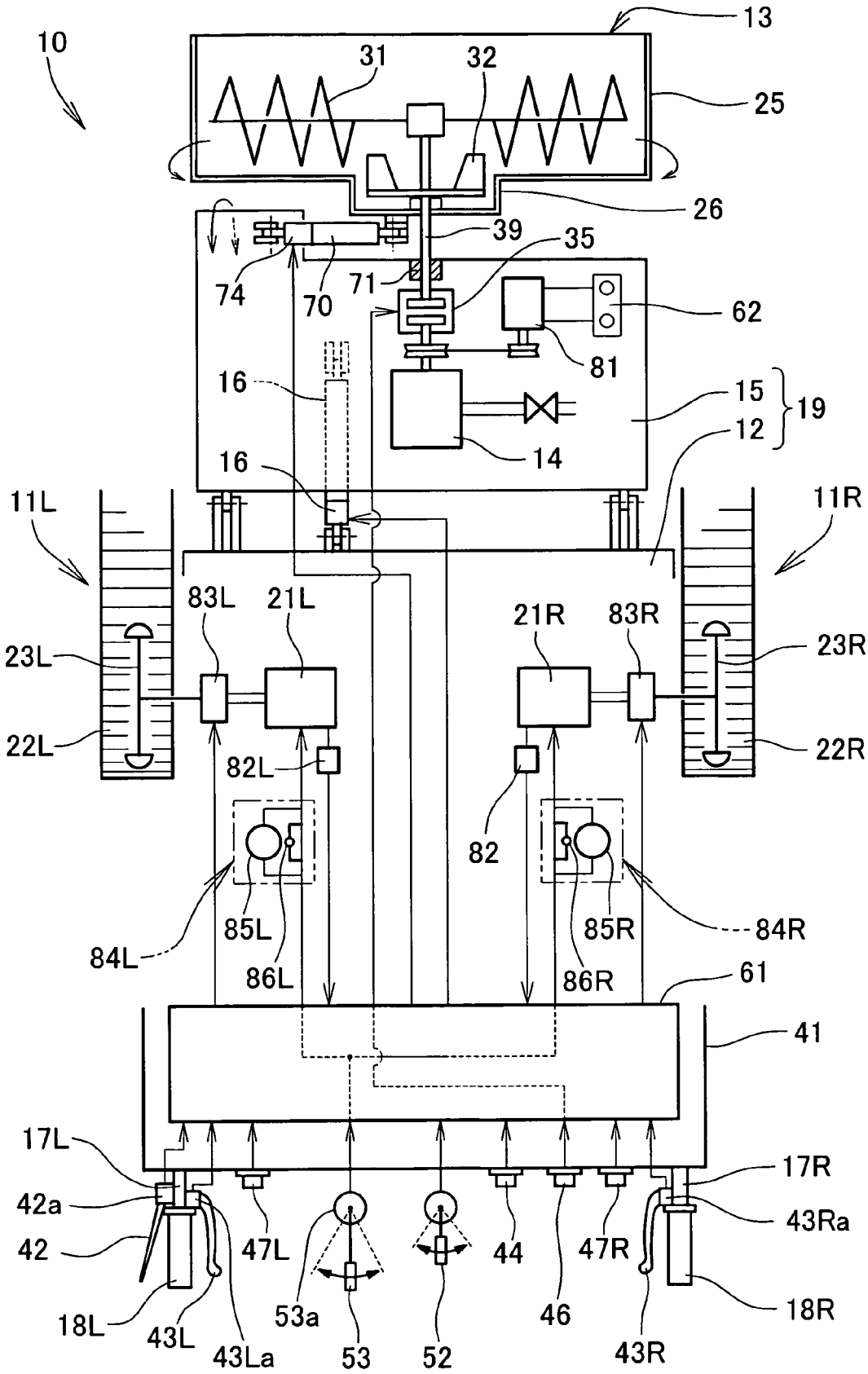
FIG. 4 is a block diagram of a control system in the snow removing machine of the invention.

The auger housing elevator mechanism 16 is an actuator having a piston movable out of and into a cylinder. This actuator is an electric hydraulic cylinder where the piston is caused to expand and contract by hydraulic pressure produced by means of a not-shown hydraulic pump driven by an electronic motor 16*a* (FIG. 4). The electronic motor 16*a* is an elevator drive source fixed to a side portion of the cylinder of the auger housing elevator mechanism 16.

The human operator can manipulate the snow removing machine 10 via the operating handles 17L and 17R while walking behind the machine 10. In the illustrated example, an operation box 41, control section 61 and battery 62 are arranged, in a top-to-bottom direction in the mentioned order, between the operating handles 17L and 17R. Reference numeral 63 represents a machine cover.

Figure 2:
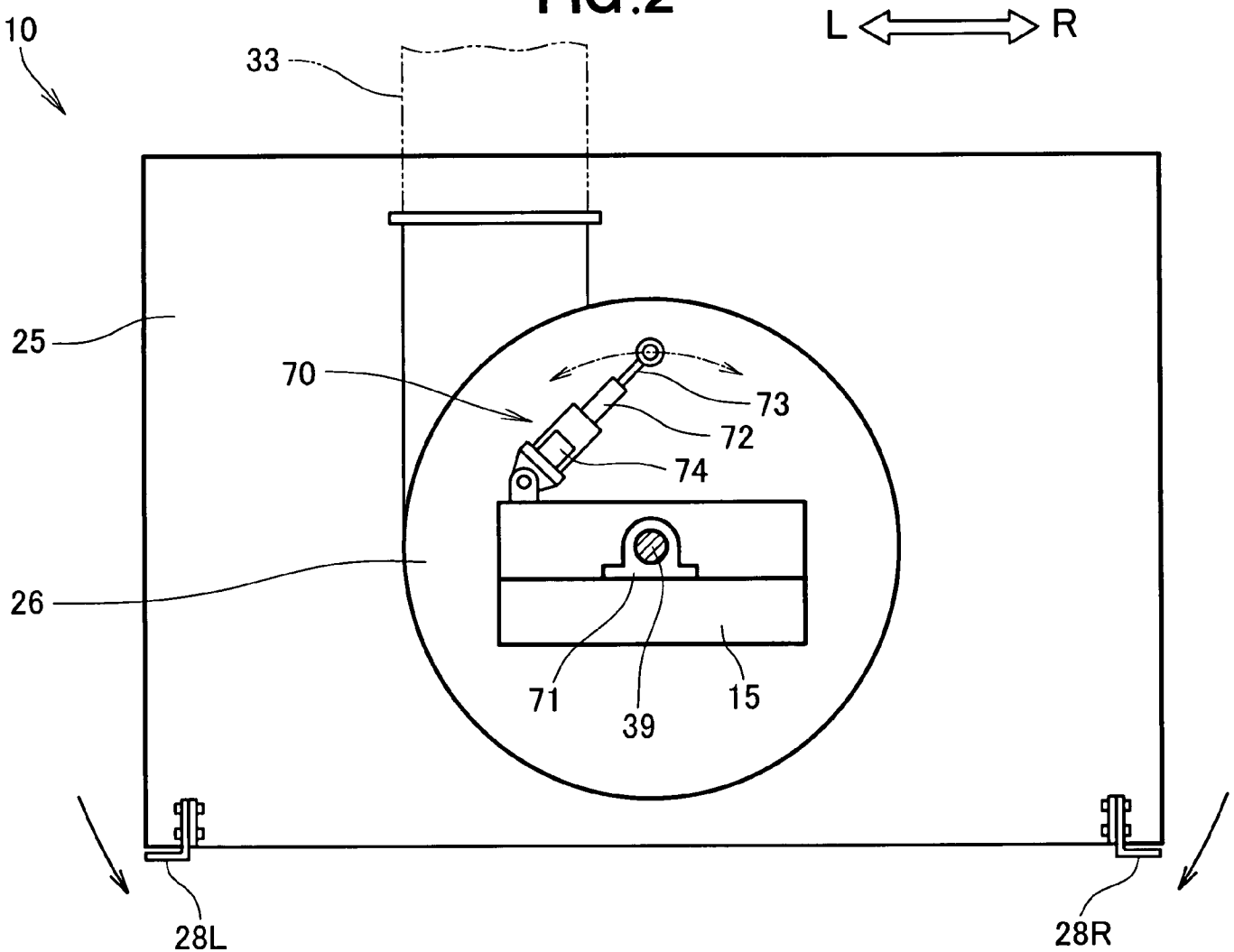
FIG. 2 is rear end view of an auger housing and blower case in the snow removing machine of the invention.

FIG. 2 is rear end view of the auger housing and blower case in the first embodiment of the present invention. In the snow removing machine 10, as shown in FIGS. 1 and 2, the auger housing 25 and blower case 26 are rollably mounted on the running-device frame 12; the auger housing 25 is rolled by means of a rolling drive mechanism 70.

More specifically, the rotation shaft 39 extending forward/rearward direction of the machine 10 is rotatably supported not only on a front end portion of the vehicle body frame 15 via a bearing 71, but also on the blower case 26 via a bearing (not shown). Thus, the auger housing 25 and blower case 26 are connected to the vehicle body frame 15 so that they are rotatable (or rollable) about the rotation shaft 39 in clockwise and counter-clockwise as viewed from the human operator (see FIG. 12).

As set forth above, the running-device frame 12 has the vehicle body frame 15 connected thereto. In this way, the auger housing 25 and blower case 26 are rollably connected to the running-device frame 12. As a result, the auger housing 25 is movable up and down and rollable relative to the running-device frame 12.

The rolling drive mechanism 70 is an actuator having a piston (rod) 73 movable out of and into a cylinder 72. This actuator is an electric hydraulic cylinder where the piston is caused to expand and contract by hydraulic pressure produced by means of a not-shown hydraulic pump driven by an electronic motor 74. The electronic motor 74 is a rolling drive source fixed to a side portion of the cylinder 72 of the rolling drive mechanism 70.

The rolling drive mechanism 70 is connected at one end (i.e., lower end of the cylinder 72) to the vehicle body frame 15 for pivotal movement in the leftward/rightward direction, and connected at the other end (i.e., distal end of the piston 73) to the rear surface of the blower case 26. Thus, the auger housing 25 and blower case 26 can be rolled by means of the rolling drive mechanism 70. As set forth above and shown in FIGS. 1 and 2, the left and right sleds 28L and 28R are provided on left lower end portions of the auger housing 25.

Figure 3:
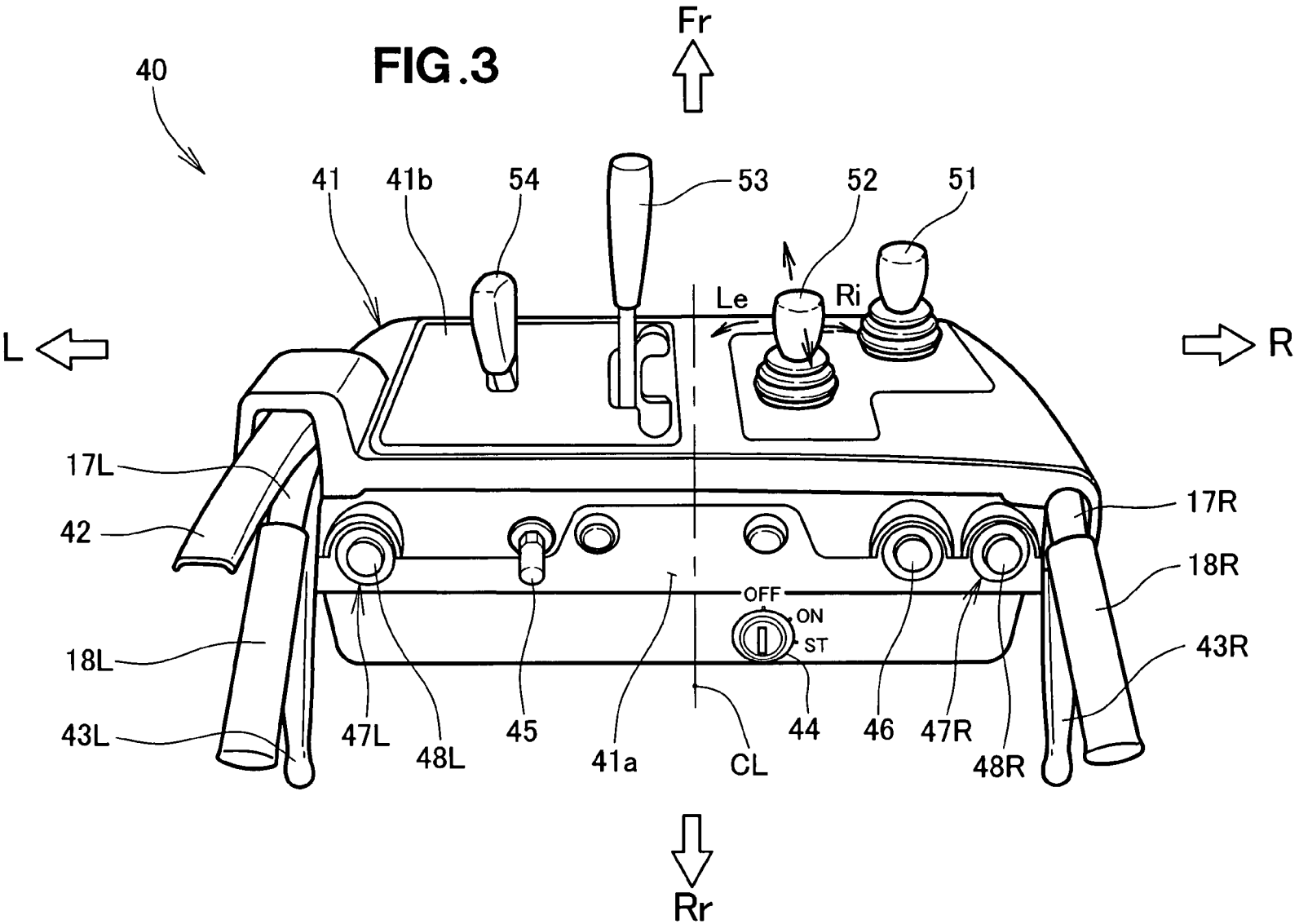
FIG. 3 is a perspective view taken in a direction of arrow 3 in FIG. 1.

FIG. 3 is a perspective view taken in a direction of arrow 3 in FIG. 1, which particularly shows an operation section 40 of the snow removing machine 10. As shown, the operation section 40 includes the above-mentioned operation box 41, a travel-standby lever 41 and left turning operation lever 43L provided on the left operating handle 17L near the left grip 18L, and a right turning operation lever 43R provided on the right operating handle 17R near the right grip 18R.

The travel-standby lever 42 is an operating member acting on a switch 42*a* (FIG. 4). The switch 42*a* is turned off when the lever 42 is brought to a released or free position (i.e., position illustrated in the figure) by resilient pulling action of a return spring. When the human operator uses his or her left hand to hold and depress the travel-standby lever 42 toward the left grip 18L, the switch 42*a* is turned on.

The left and right turning switches 43La and 43Ra are each turned off when the corresponding left or right turning operation lever 43L or 43R is brought to a released free position (i.e. position illustrated in the figure) by resilient pulling action of a return spring. When the human operator uses his or her left hand to hold and depress the left turning operation lever 43L toward the left grip 18L, the left turning switch43La is turned on. Similarly, when the human operator uses the right hand to hold and depress the right turning operation lever 43R toward the right grip 18R, the right turning switch 43Ra is turned on. Whether or not the left or right turning operation lever 43L or 43R is being held by the human operator is detectable on the basis of the ON/OFF state of the corresponding turning switch 43La or 43Ra.

Referring now to FIG. 3 in combination with FIG. 1, the operation box 41 includes, on its rear surface 41*a* (i.e., surface closer to the human operator), a main switch 44, a choke knob 45 operable when the engine 14 is started, and a clutch operating switch (or auger switch) 46 for turning on/off the electromagnetic clutch 34. The engine 14 can be activated by inserting a key in the main switch (key switch) 44 and turning the inserted key to a start position "ST".

The operation box 41 includes, on its upper surface 41*b*, a shooter operating lever 51 for changing an operating direction of the shooter 33, an auger-housing-posture manipulating lever 52, a direction/speed control lever (forward/rearward-traveling-speed adjusting lever) 53, and a throttle value 54 for adjusting the number of rotations of the engine 14.

The auger-housing-posture manipulating lever 52 is an operating member for operating the auger housing elevator mechanism 16 and rolling drive mechanism 70 to move the auger housing 25 upward or downward in accordance with the snow surface during snow removal work using the auger 31.

The piston of the auger housing elevator mechanism 16 can be caused to expand by the human operator pivoting the auger-housing-posture manipulating lever 52 rearward from a neutral position shown in FIG. 3. Further, the piston of the auger housing elevator mechanism 16 can be caused to contract by the human operator pivoting the auger-housing-posture manipulating lever 52 forward from the neutral position shown in FIG. 3. The piston 73 (FIG. 2) of the rolling drive mechanism 70 can be caused to contract by the human operator pivoting the auger-housing-posture manipulating lever 52 leftward from the neutral position shown in FIG. 3. Further, the piston of the rolling drive mechanism 70 can be caused to expand by the human operator pivoting the auger-housing-posture manipulating lever 52 rightward from the neutral position shown in FIG. 3.

FIG. 4 is a block diagram of a control system in the snow removing machine 10, which particularly shows various components and information transmission paths in the control section 61. Flows of instructions in the control section 61 are indicated in the figure by broken lines; however, these flows are just for illustrative purposes.

The snow removable work section 13 and related components operate as follows. Power generator 81 is driven by a portion of the output of the engine 14, and electric power thus produced by the generator 81 is supplied to the battery 62, electric motors 21L and 21R and other electric equipment. The remaining portion of the output of the engine 14 is supplied to rotate the auger 31 and blower 32. Reference numerals 82L and 82R represent rotation sensors for measuring rotating speeds of the left and right electric motors 2 1L and 21R.

Once the human operator operates the clutch operating switch 46 while griping the travel-standby lever 42, the electromagnetic clutch 35 is brought to a connecting state so that the auger 31 and blower 32 can be driven to rotate by the power of the engine 14. The electromagnetic clutch 35 can be brought back to a disconnecting state by the human operator shifting the travel-standby lever 42 to the free position or again operating the clutch operating switch 46.

The running devices 11L and 11R and related components operate as follows. The snow removing machine 10 includes left and right electromagnetic brakes 83L and 83R that function like parking brakes of ordinary vehicles. Specifically, the respective rotation shafts of the left and right motors 21L and 21R can be braked by the corresponding electromagnetic brakes 83L and 83R. During parking of the snow removing machine 10, the electromagnetic brakes 83L and 83R are kept in a braking (i.e., ON) state under control of the control section 61. The electromagnetic brakes 83L and 83R can be shifted to a non-braking (OFF or open) state once the direction/speed control lever 53 is shifted to a forward or rearward travel (i.e., advance or retreat) position while 1) the main switch 44 is in the "ON" position and 2) the travel-standby lever 42 is being gripped by the human operator.

Figure 5:
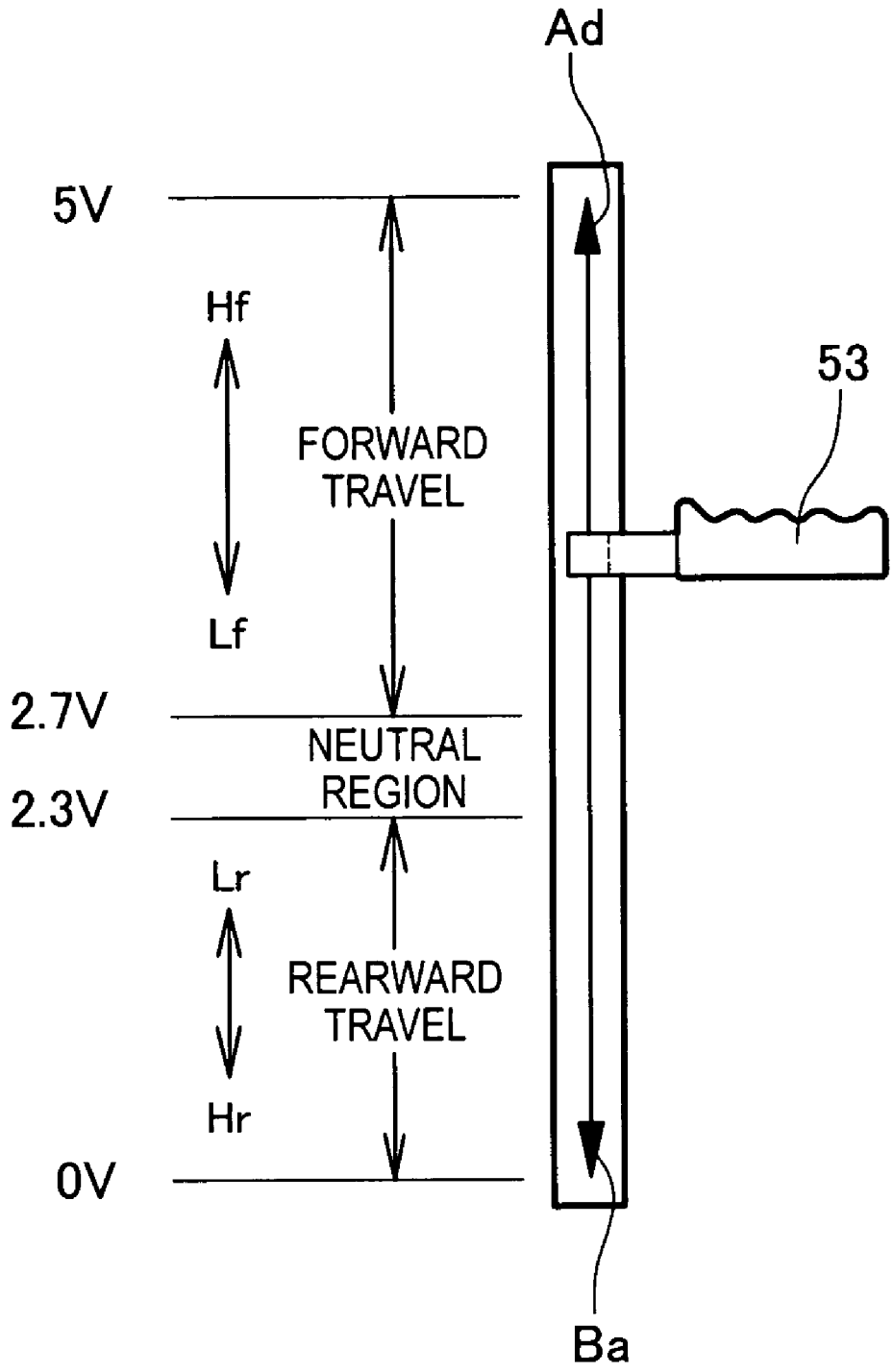
FIG. 5 is a diagram explanatory of operation of a direction/speed control lever employed in the snow removing machine of the invention.

FIG. 5 is a diagram explanatory of operation of the direction/speed control lever 53 employed in the snow removing machine 10. As seen in FIG. 5, the direction/speed control lever 53 is reciprocatively movable in opposite directions as indicated by arrows Ad and Ba. As the direction/speed control lever 53 is shifted or turned from a "neutral" region to a "forward travel" region, the vehicle 10 can move forward. In the "forward travel" region, speed control can be performed such that the machine 10 is variable in forward traveling speed between a lowest speed Lf and a highest speed Hf. Similarly, as the direction/speed control lever 53 is shifted or turned from the "neutral" region to a "rearward travel" region, the vehicle 10 can move rearward. In the "rearward travel" region, speed control can be performed such that the machine 10 is variable in rearward traveling speed between a lowest speed Lr and a highest speed Hr. In the illustrated example of FIG. 5, voltages corresponding to the various positions of the direction/speed control lever 53 are generated via a potentiometer. For example, the potentiometer 53*a* generates 0 volt (V) when the direction/speed control lever 53 is at the highest-rearward-traveling-speed position, 5 V when the lever 53 is at the highest-forward-traveling-speed position, and 2.3 V-2.7 V when the lever 53 is in the neutral region, as indicated on a left end area of the figure. In this way, the single direction/speed control lever 53 can set both a desired one of the forward and rearward travel directions and a desired speed between the highest and lowest travel speeds; this is why the direction/speed control lever 53 is so named.

Referring back to FIG. 4, the control section 61, in accordance with position information of the direction/speed control lever 53 received from the potentiometer 53*a*, rotates the left and right electric motors 21L and 21R via left and right motor drivers 84L and 84R. The control section 61 detects the respective numbers of rotations of the motors 21L and 21R via the rotation sensors 82L and 82R and performs feedback control so that the rotating speeds of the motors 21L and 21R assume predetermined values on the basis of detection signals given from the sensors 82L and 82R. As a consequence, the left and right driving wheels 21L and 21R can rotate in desired directions and at desired speeds, so that the snow removing machine 10 can be brought to desired traveling conditions.

During travel of the snow removing machine 10, the machine 10 is braked in the following manner. For the braking purposes, the left and right motor drivers 84L and 84R each include a regenerative brake circuit 85L or 85R, and a short-circuit brake circuit 86L or 86R as a brake means.

While the human operator is gripping the left turning operation lever 43L to keep the left turning switch 43La in the ON state, the control section 61 activates the left regenerative brake circuit 85L to thereby lower the speed of the left electric motor 21L. Similarly, while the human operator is gripping the right turning operation lever 43R to keep the right turning operation switch 43Ra in the ON state, the control section 61 activates the right regenerative brake circuit 85R to thereby lower the speed of the right electric motor 21R.

Namely, the snow removing machine 10 can be turned to the left only while the human operator is gripping the left turning operation lever 43L, and the snow removing machine 10 can be turned to the right only while the human operator is gripping the right turning operation lever 43R.

Then, the snow removing machine 10 can be caused to stop traveling by the human operator (1) releasing the travel-standby lever 42, (2) returning the main switch 44 to the OFF position, or (3) returning the direction/speed control lever 53 to the neutral position.

Figure 6:
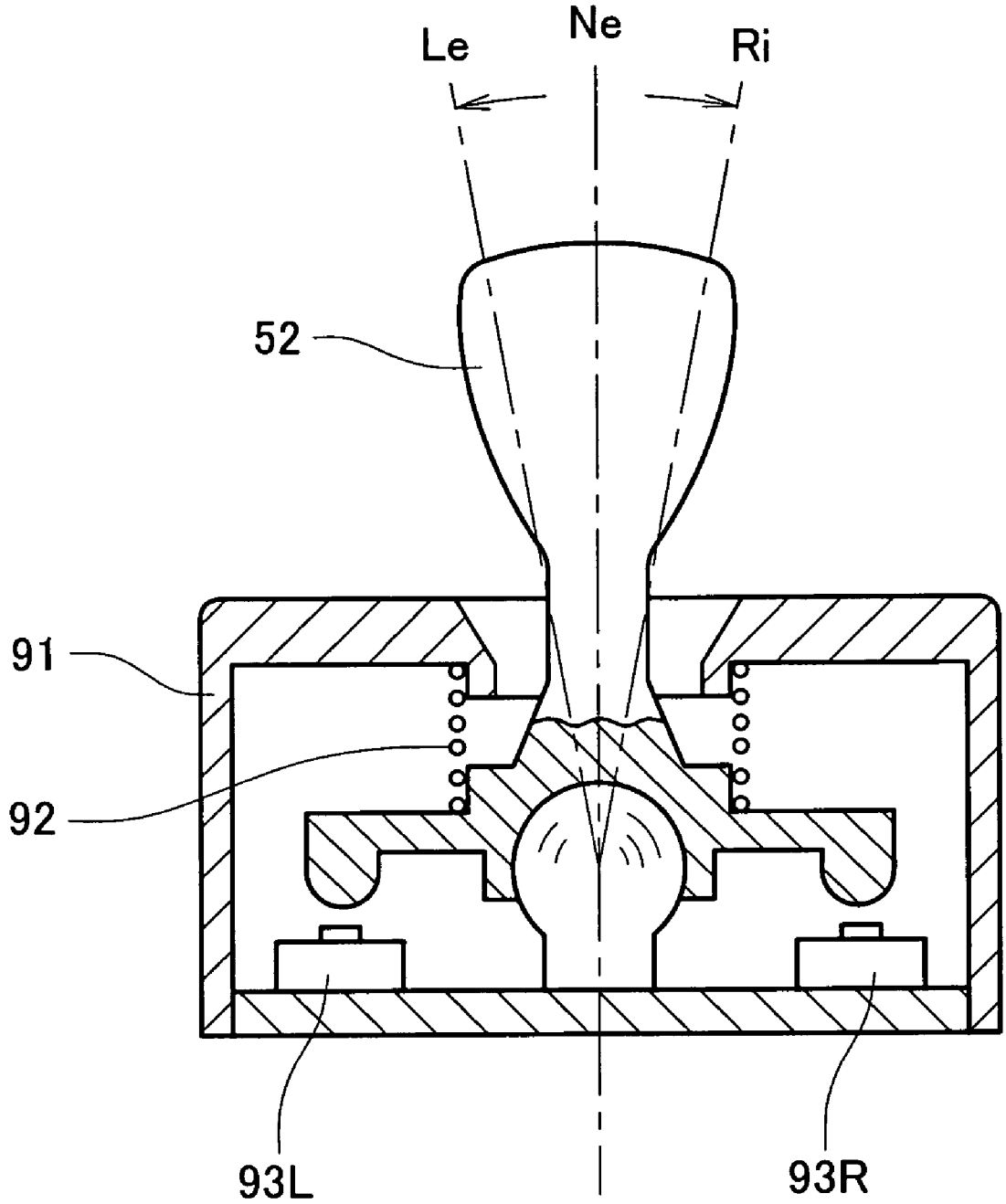
FIG. 6 is a sectional view showing an auger-housing-posture manipulating lever and related switches employed in the snow removing machine of the invention.

FIG. 6 is a sectional view showing the auger-housing-posture manipulating lever 52 and related switches. As shown in FIG. 6, the auger-housing-posture manipulating lever 52 is supported at one end within a case 91 in such a manner that the lever 52 is pivotable in forward/rearward and leftward/rightward directions. The auger-housing-posture manipulating lever 52 is also normally biased by a resilient member 92 so that it can automatically return to a neutral position Ne. Namely, the auger-housing-posture manipulating lever 52 is a lever mechanism that automatically returns to the neutral position Ne when released. On the inner surface of the case 91, there are provided four rolling switches, i.e. front and rear rolling switches and left and right rolling switches, of which only the left and right rolling switches 93L and 93R are shown in the figure.

As seen from FIGS. 3 and 6, the left rolling switch 93L is turned on in response to human operator's pivoting operation of the auger-housing-posture manipulating lever 52 from the neutral position Ne to a left rolling position Le (namely, left rolling operation) and kept in the ON state only while the auger-housing-posture manipulating lever 52 is in the left rolling position Le. Similarly, the right rolling switch 93R is turned on in response to human operator's pivoting operation of the auger-housing-posture manipulating lever 52 from the neutral position Ne to a right rolling position Ri (namely, right rolling operation) and kept in the ON state only while the auger-housing-posture manipulating lever 52 is in the right rolling position Ri.

Further, as seen from FIGS. 4 and 6, the electric motor 16*a* of the auger housing elevator mechanism 16 is shiftable between forward and reverse rotations in response to human operator's pivoting operation of the auger-housing-posture manipulating lever 52 in the forward/rearward directions, so that the piston of the auger housing elevator mechanism 16 can be caused to expand or contract.

Figure 12:
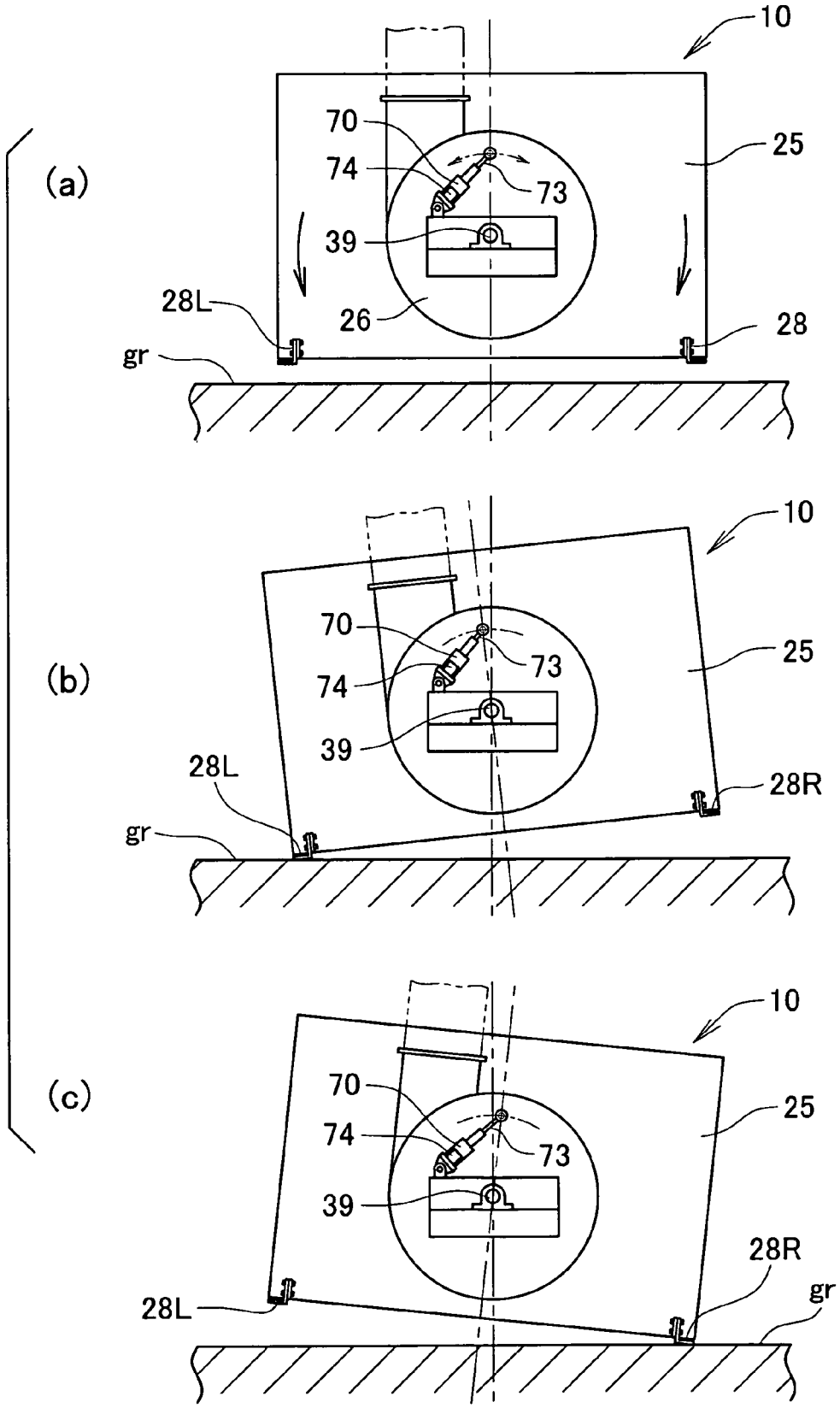
FIG. 12 is a view explanatory of behavior of the snow removing machine of the present invention.

Furthermore, as seen from FIGS. 2 and 6, the left rolling switch 93L is turned on in response to the left rolling operation of the auger-housing-posture manipulating lever 52, so that the electric motor 74 of the rolling drive mechanism 70 rotates in the forward direction to cause the piston 73 to contract. As a consequence, the auger housing 25 and blower case 26 are rolled to the "left" (i.e., in the counterclockwise direction as viewed from the human operator as seen in FIG. 12). The right rolling switch 93R is turned on in response to the right rolling operation of the auger-housing-posture manipulating lever 52, so that the electric motor 74 of the rolling drive mechanism 70 rotates in the reverse direction to cause the piston 73 to expand. As a consequence, the auger housing 25 and blower case 26 is rolled to the "right" (i.e., in the clockwise direction as viewed from the human operator as seen in FIG. 12).

Note that the aforementioned left and right turning operator members may be in the form of left and right turning operation switches 47L and 47R of FIG. 3 rather than the left and right turning operation levers 43L and 43R. In such a case, the left and right turning operation switches 47L and 47R are provided on the operation box 41 between the operating handles 17L and 17R at positions within ranges operable by the two hands of the human operator holding the left and right grips 18L and 18R.

The left turning operation switch 47L is a push-button switch including a push button 48L oriented toward the rear of the snow removing machine 10 (i.e., toward the human operator). The left turning operation switch 47L is an automatically-reset switch that is kept ON to generate a predetermined switch signal only while the push button 48L is being depressed by the human operator.

Similarly, the right turning operation switch 47R is a push-button switch including a push button 48R oriented toward the rear of the snow removing machine 10 (i.e., toward the human operator). The right turning operation switch 47R is an automatically-reset switch that is kept ON to generate a predetermined switch signal only while the push button 48R is being depressed by the human operator.

These left and right turning operation switch 47L and 47R take the place of the left and right turning switches 43La and 43Ra of FIG. 4.

More specifically, the left turning switch 47L and its push button 48L are provided on a left end portion of the rear surface 41*a* of the operation box 41 inwardly of the left grip 18L (namely, located closer than the grip 18L to a longitudinal centerline CL of the machine 10. The right turning switch 47R and its push button 48R are provided on a right end portion of the rear surface 41*a* of the operation box 41 inwardly of the right grip 18L (namely, located closer than the grip 18L to the longitudinal centerline CL of the machine 10.

When the human operator grips the left and right operating handles 18L and 18R with both hands, the thumb of each of the hands is generally located between the handles 18L and 18R, i.e. the thumb nail faces inward (toward the longitudinal centerline CL). The snow removing machine 10 can be turned left only when the human operator is depressing the push button 48L of the left turning operation switch 47L with the thumb of the left hand extended forward while gripping the left and right grips 18L and 18R. Similarly, the snow removing machine 10 can be turned right only when the human operator is depressing the push button 48R of the right turning operation switch 47R with the thumb of the right hand extended forward. In this way, the human operator can perform desired turning operation extremely easily with a small force without releasing or letting go of any of the left and right grips 18L and 18R.

Now, with primary reference to flow charts of FIGS. 7-10, a description will be made about a flow of various control operations performed by the control section 61 of FIG. 4 in the case where the control section 61 is implemented by a microcomputer. For example, this control flow is started up in response to turning-on of the main switch 44 and brought to an end in response to turning-off of the main switch 44.

Figure 7:
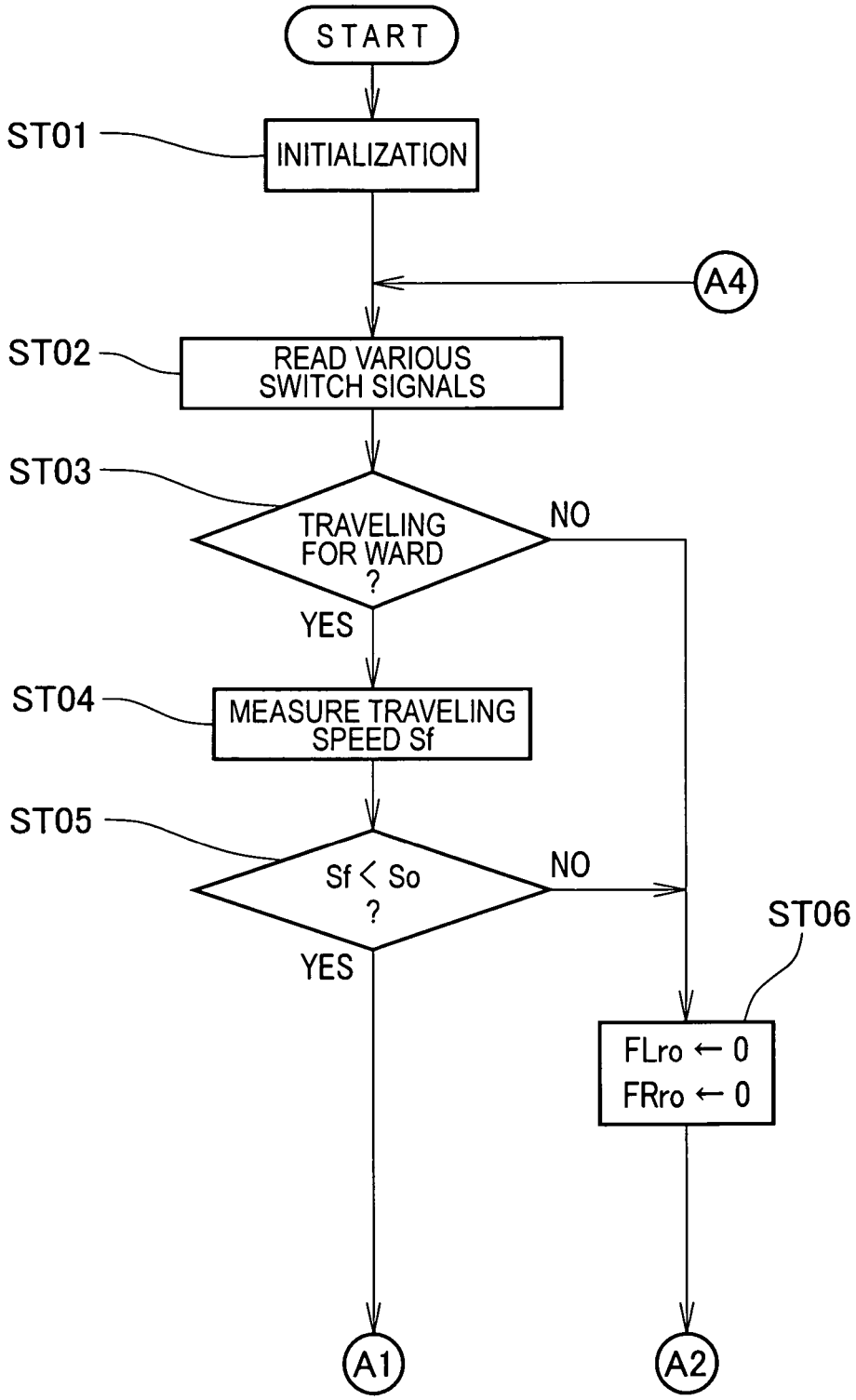
FIG. 7 is a flow chart showing a portion of an example flow of control operations performed by a control section in the snow removing machine of the invention.

FIG. 7 is a flow chart showing a portion of an example flow of control operations performed by the control section 61.

Step ST01 of FIG. 7: A predetermined initialization process is performed; specifically, various flags, such as a left rolling flag Fro, right rolling FRro, preceding left rolling flag bFLr and preceding right rolling flag bFRr, are all set at an initial value "0", and a left roll amount Lro and right roll amount Rro are also set to "0". The left rolling flag FLro is a flag indicating whether or not the auger housing 25 should be rolled to the left (in the counterclockwise direction), and the right rolling flag FRro is a flag indicating whether or not the auger housing 25 should be rolled to the right (in the clockwise direction).

Step ST02: Signals from various switches are read.

Step ST03: A determination is made as to whether the snow removing machine 10 is currently moving forward. With a YES determination, the control section 61 proceeds to step ST04, while, with a NO determination, the control section 61 branches to step ST06. It is determined that the snow removing machine 10 is currently traveling forward, if the aforementioned three conditions, i.e. the condition that the main switch 44 is in the ON position, the condition that the travel-standby lever 42 is currently being gripped by the human operator and the condition that the direction/speed control lever 53 is in the "forward travel" region, have been met.

Step ST04: Current traveling speed Sf of the snow removing machine 10 is measured; for example, it may be measured on the basis of the rotating speeds of the electric motors 21L and 21R measured via the rotation sensors 82L and 82R.

Step ST05: A determination is made as to whether the traveling speed Sf of the snow removing machine 10 is lower than a preset reference speed So. With a YES determination, the control section 61 proceeds to an out-connector A1, while, with a NO determination, the control section 61 branches step ST06.

When the snow removing machine 10 is to be turned during high-speed travel of the machine 10, the control section 61 performs control to gradually slow down the left or right running device 11L or 11R. The human operator can cause the snow removing machine 10 to make a rapid turn, by rolling the auger housing 25 to cause a portion of one of the side edges of the auger housing 25, which is located inwardly of the other side edge as viewed in the turning direction, to contact the ground surface. For that purpose, the reference speed So is set within a speed range that permits rapid turns, e.g. 0.3 m/sec close to a speed in a stop (i.e., non-traveling) state of the vehicle.

Step ST06: The left rolling flag FLro and right rolling flag FRro are each set at "0", and then the control section 61 proceeds to an output-connector A2.

Figure 8:
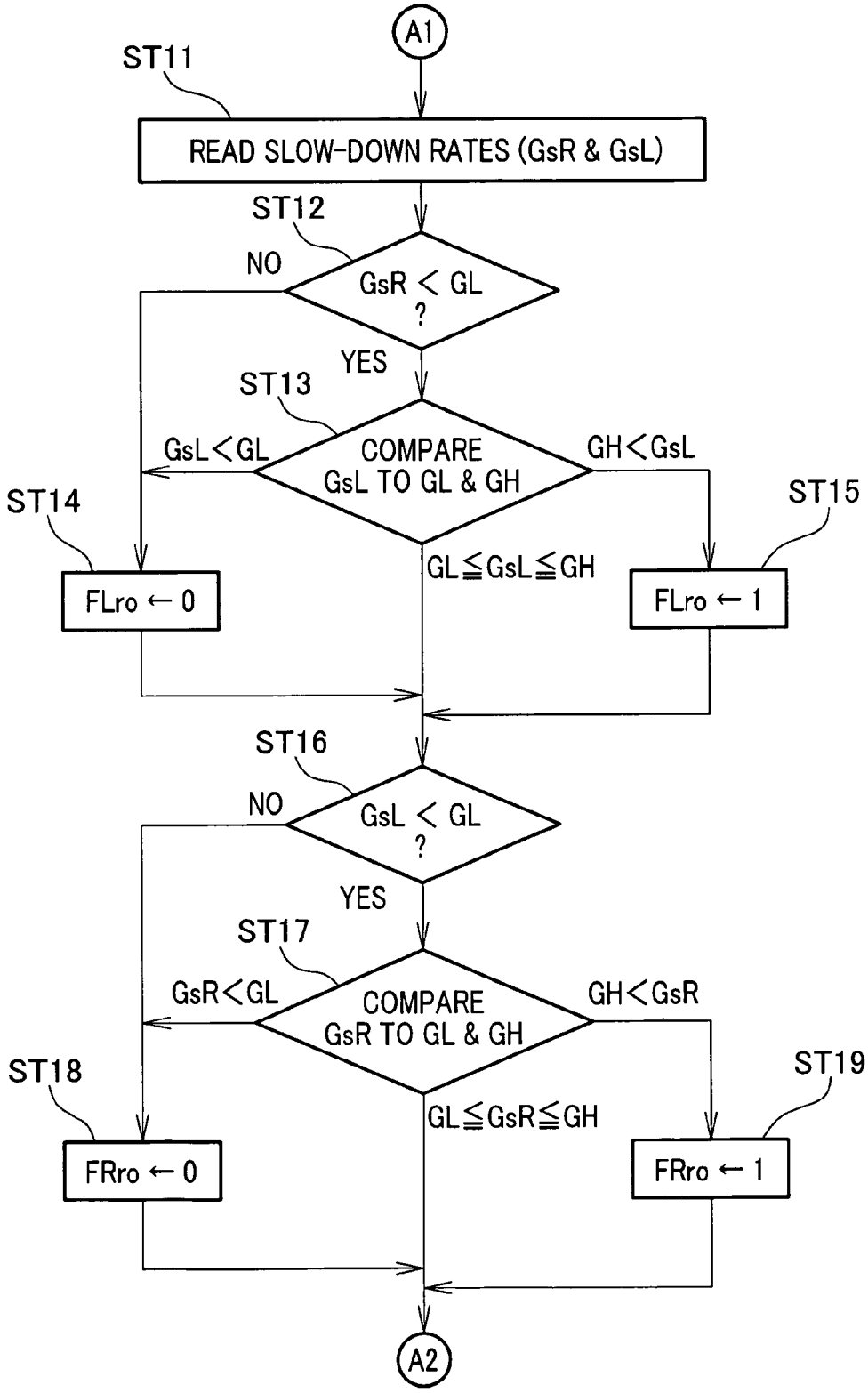
FIG. 8 is a flow chart showing another portion of the flow of control operations performed by the control section in the snow removing machine of the invention.

FIG. 8 is a flow chart showing another portion of the flow of control operations performed by the control section 61.

Step ST11: The control section 61 reads left and right slow-down rates GsL and GsR to be applied when the snow removing machine 10 is to be turned. The left and right slow-down rates GsL and GsR are expressed in percentage and vary in accordance with a degree of slow-down to be effected for one of the left and right running devices 11L or 11R which is located inwardly of the other 11R or 11L as viewed in the turning direction.

When the snow removing machine 10 is to be turned, one of the left and right running devices 11L or 11R which is located inwardly of the other 11R or 11L as viewed in the turning direction, i.e. the "inner" running device 11L or 11R, is slowed down in the present invention. Whether or not and how rapidly the human operator wants to turn the snow removing machine 10 is determined, in the illustrated example, in accordance with a value of the left or right slow-down rates GsL or GsR to be applied to the "inner" running device 11L or 11R. Namely, a greater value of the left or right slow-down rates GsL or GsR indicates that the human operator wants to turn the snow removing machine 10 more rapidly.

Step ST12: A determination is made as to whether the right slow-down rate GsR is smaller than a preset small rate threshold value GL (GsR<GL). With a YES determination, the control section 61 moves on to step ST13, while, with a NO determination, the control section 61 branches to step ST14. The preset small rate threshold value GL is expressed in percentage (%) and set at, for example, 40% in this case. If the right slow-down rate GsR is equal to or greater than the preset small rate threshold value GL (NO determination at step ST12), it means that the human operator wants to turn the snow removing machine 10 to the right, so that left rolling control is turned off (canceled).

Step ST13: The left slow-down rate GsL is compared to the preset small rate threshold value GL and great-rate threshold value GH. The preset great rate threshold value GH is also expressed in percentage (%) and set at, for example, 60% in this case. If the left slow-down rate GsL is smaller than the preset small rate threshold value GL (GsL<GL), the control section 61 judges that it is not necessary to rapidly turn the machine 10 to the left and goes to step ST14. If the left slow-down rate GsL is greater than the preset great rate threshold value GH (GH<GsL), the control section 61 judges that it is necessary to rapidly turn the machine 10 to the left and branches to step ST15. If the left slow-down rate GsL is in the range from the small rate threshold value GL to the great rate threshold value GH (GL≦GsL≦GH), the control section 61 judges that the current state should be maintained and goes to step ST16.

Step ST14: The left rolling flag FLro is set at "0", and then the control section 61 proceeds to step ST16.

Step ST15: The left rolling flag FLro is set at "1", and then the control section 61 proceeds to step ST16.

Step ST16: A determination is made as to whether the left slow-down rate GsL is smaller than the preset small rate threshold value GL (GsL<GL). With a YES determination, the control section 61 moves on to step ST17, while, with a NO determination, the control section 61 branches to step ST18. If the left slow-down rate GsL is equal to or greater than the preset small rate threshold value GL (NO determination at step ST16), it means that the human operator wants to turn the snow removing machine 10 to the left, so that right rolling control is turned off (canceled).

Step ST17: The right slow-down rate GsR is compared to the preset small rate threshold value GL and great rate threshold value GH. If the right slow-down rate GsR is smaller than the preset small rate threshold value GL (GsR<GL), the control section 61 judges that it is not necessary to rapidly turn the machine 10 to the right and goes to step ST18. If the left slow-down rate GsR is greater than the preset great rate threshold value GH (GH<GsR), the control section 61 judges that it is necessary to rapidly turn the machine 10 to the right and branches to step ST19. If the right slow-down rate GsR is in the range from the small rate threshold value GL to the great rate threshold value GH (GL≦GsR≦GH), the control section 61 judges that the current state should be maintained and goes to an out-connector A2.

Step ST18: The right rolling flag FRro is set at "0", and then the control section 61 proceeds to the out-connector A2.

Step ST19: The right rolling flag FRro is set at "1", and then the control section 61 proceeds to the out-connector A2.

Figure 9:
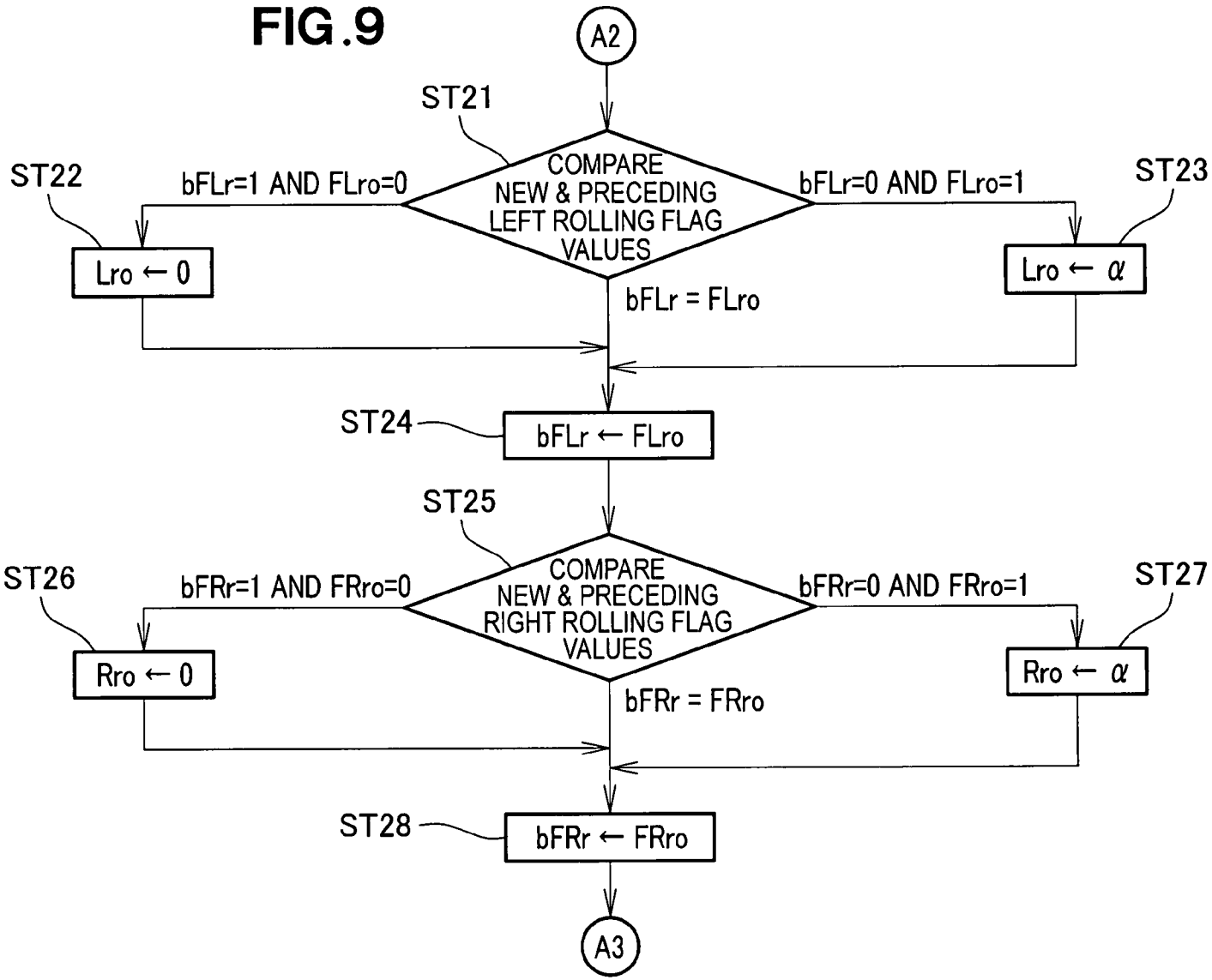
FIG. 9 is a flow chart showing still another portion of the flow of control operations performed by the control section in the snow removing machine of the invention.

FIG. 9 is a flow chart showing still another portion of the flow of control operations performed by the control section 61.

Step ST21: Newest value of the left rolling flag FLro (hereinafter "new left rolling flag value FLro") is compared to the preceding value of the left rolling flag (hereinafter "preceding left rolling flag value bFLr"). If the preceding left rolling flag value bFLr is "1" and new left rolling flag value FLro is "0", the control section 61 judges that left rolling of the auger housing 25 responsive to left turning operation is to be terminated and goes to step ST22. If the preceding left rolling flag value bFLr is "0" and new left rolling flag value FLro is "1", the control section 61 judges that left rolling of the auger housing 25 is to be started in response to left turning operation and goes to step ST23. If the new left rolling flag value FLro agrees with the preceding left rolling flag value bFLr, the control section 61 judges that the current state is to be maintained and goes to step ST24.

Step ST22: The left roll amount Lro is set to "0", and then the control section 61 proceeds to step ST24.

Step ST23: The left roll amount Lro is set to $\alpha$, and then the control section 61 proceeds to step ST24. "$\alpha$" represents a predetermined roll amount in a range for rolling the auger housing 25 to the left or right from the neutral position. The predetermined roll amount $\alpha$ is set, for example, at a value that can cause an end portion of the inner side edge of the auger housing 25 (i.e., sled 28L or 28R), as viewed in the turning direction, to contact the ground surface.

Step ST24: The preceding left rolling flag value bFLr is rewritten with the new left rolling flag value FLro, and then the control section 61 goes to step ST25.

Step ST25: Newest value of the right rolling flag FRro (hereinafter "new right rolling flag value FRro") is compared to the preceding value of the right rolling flag (hereinafter "preceding right rolling flag value bFRr"). If the preceding right rolling flag value bFRr is "1" and new right rolling flag value FRro is "0", the control section 61 judges that right rolling of the auger housing 25 responsive to right turning operation is to be terminated and goes to step ST26. If the preceding right rolling flag value bFRr is "0" and new right rolling flag value FRro is "1", the control section 61 judges that right rolling of the auger housing 25 is to be started in response to right turning operation and goes to step ST27. If the new right rolling flag value FRro agrees with the preceding right rolling flag value bFRr, the control section 61 judges that the current state is to be maintained and goes to step ST28.

Step ST26: The right roll amount Rro is set to "0", and then the control section 61 proceeds to step ST28.

Step ST27: The right roll amount Rro is set to $\alpha$, and then the control section 61 proceeds to step ST28. "$\alpha$" represents the same predetermined roll amount as used at step ST23 above.

Step ST28: The preceding right rolling flag value bFRr is rewritten with the new right rolling flag value FRro, and then the control section 61 goes to an out-connector A3.

Figure 10:
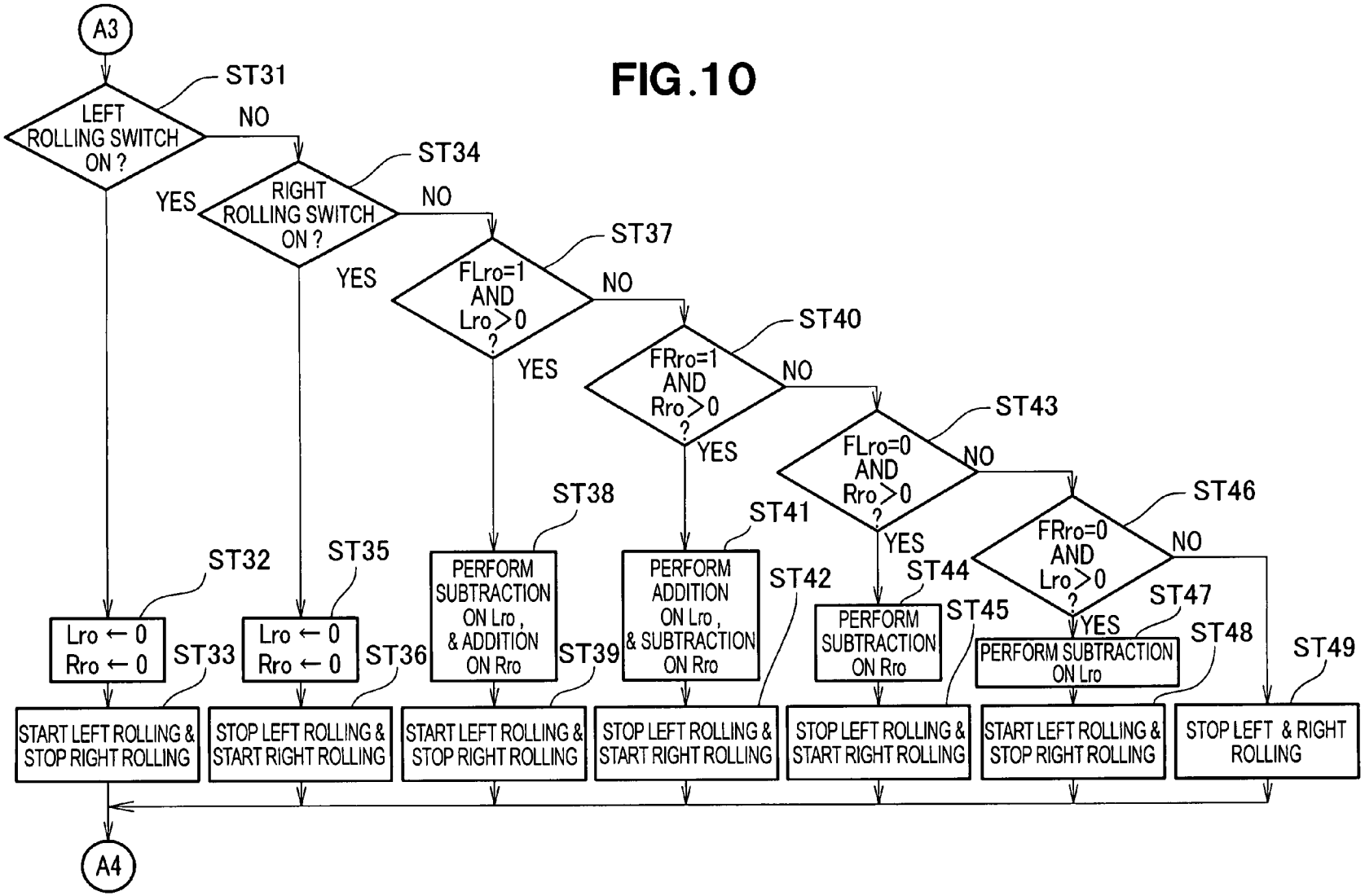
FIG. 10 is a flow chart showing the remaining portion of the flow of control operations performed by the control section in the snow removing machine of the invention.

FIG. 10 is a flow chart showing the remaining portion of the flow of control operations performed by the control section 61.

Step ST31: A determination is made as to whether the left rolling switch 93L (see FIG. 6) is ON or not. With a YES determination, the control section 61 proceeds to step ST32, while, with a NO determination, the control section 61 goes to step S34. Note that the left rolling switch 93L is ON if the auger-housing-posture manipulating lever 52 is being operated to effect left rolling.

Step ST32: The left and right roll amounts Lro and Rro are each set to "0", and then the control section 61 proceeds to step ST33.

Step ST33: The control section 61 issues a left rolling instruction to the electric motor 74 of the rolling drive mechanism 70 and then reverts to step ST02 via an out-connector A4 of FIG. 10 and in-connector A4 of FIG. 7. Namely, the control section 61 issues a control signal for starting the left rolling operation of the auger housing 25 and a control signal for stopping the right rolling operation of the auger housing 25. In this way, the auger housing 25 is caused to roll to the left while the human operator is operating the auger-housing-posture manipulating lever 52 to effect left rolling during the snow removal work.

Step ST34: A determination is made as to whether the right rolling switch 93R (see FIG. 6) is ON or not. With a YES determination, the control section 61 proceeds to step ST35, while, with a NO determination, the control section 61 goes to step S37. Note that the right rolling switch 93R is ON while the auger-housing-posture manipulating lever 52 is being operated to effect right rolling.

Step ST35: The left and right roll amounts Lro and Rro are each set to "0", and then the control section 61 proceeds to step ST36.

Step ST36: The control section 61 issues a right rolling instruction to the electric motor 74 of the rolling drive mechanism 70 and then reverts to step ST02 via the out-connector A4 of FIG. 10 and in-connector A4 of FIG. 7. Namely, the control section 61 issues a control signal for starting the right rolling operation of the auger housing 25 and a control signal for stopping the left rolling operation of the auger housing 25. In this way, the auger housing 25 is caused to roll to the right while the human operator is operating the auger-housing-posture manipulating lever 52 to effect right rolling during the snow removal work.

Step ST37: A determination is made as to whether the value of the left rolling flag FLro is "1" and the left roll amount Lro is greater than "0" (i.e., FLro=1 and Lro>0). If answered in the affirmative, the control section 61 judges that left rolling is to be effected and moves on to step ST38, while, if answered in the negative, the control section 61 branches to step ST40.

Step ST38: Subtraction is performed on the left roll amount Lro while an addition is performed on the right roll amount Rro, and then the control section 61 proceeds to step ST39. For example, each time this step is reached, a predetermined very small amount is subtracted from the left roll amount Lro while the same predetermined very small amount is added to the right roll amount Rro.

Step ST39: The control section 61 issues a left rolling instruction to the electric motor 74 of the rolling drive mechanism 70 and then reverts to step ST02 via the out-connector A4 of FIG. 10 and in-connector A4 of FIG. 7. Namely, the control section 61 issues a control signal for starting the left rolling operation of the auger housing 25 and a control signal for stopping the right rolling operation of the auger housing 25.

Step ST40: A determination is made as to whether the value of the right rolling flag FRro is "1" and the right roll amount Rro is greater than "0" (i.e., FRro=1 and Rro>0). If answered in the affirmative, the control section 61 judges that right rolling is to be effected and moves on to step ST41, while, if answered in the negative, the control section 61 branches to step ST43.

Step ST41: Addition is performed on the left roll amount Lro while a subtraction is performed on the right roll amount Rro, and then the control section 61 proceeds to step ST42. For example, each time this step is reached, the predetermined very small amount is added to the left roll amount Lro while the same predetermined very small amount is subtracted from the right roll amount Rro.

Step ST42: The control section 61 issues a right rolling instruction to the electric motor 74 of the rolling drive mechanism 70 and then reverts to step ST02 via the out-connector A4 of FIG. 10 and in-connector A4 of FIG. 7. Namely, the control section 61 issues a control signal for stopping the left rolling operation of the auger housing 25 and a control signal for starting the right rolling operation of the auger housing 25.

Step ST43: A determination is made as to whether the value of the left rolling flag FLro is "0" and the right roll amount Rro is greater than "0" (i.e., FLro=0 and Rro>0). If answered in the affirmative, the control section 61 judges that right rolling is to be effected to return the auger housing 25 to the original neutral position and moves on to step ST44, while, if answered in the negative, the control section 61 branches to step ST46.

Step ST44: Subtraction is performed on the right roll amount Rro, and then the control section 61 proceeds to step ST45. For example, each time this step is reached, the predetermined very small amount is subtracted from the right roll amount Rro.

Step ST45: The control section 61 issues a right rolling instruction to the electric motor 74 of the rolling drive mechanism 70 and then reverts to step ST02 via the out-connector A4 of FIG. 10 and in-connector A4 of FIG. 7. Namely, the control section 61 issues a control signal for stopping the left rolling operation of the auger housing 25 and a control signal for starting the right rolling operation of the auger housing 25.

Step ST46: A determination is made as to whether the value of the right rolling flag FRro is "0" and the left roll amount Lro is greater than "0" (i.e., FRro=0 and Lro>0). If answered in the affirmative, the control section 61 judges that left rolling is to be effected to return the auger housing 25 to the original neutral position and moves on to step ST47, while, if answered in the negative, the control section 61 branches to step ST49.

Step ST47: Subtraction is performed on the left roll amount Lro, and then the control section 61 proceeds to step ST48. For example, each time this step is reached, the predetermined very small amount is subtracted from the left roll amount Lro.

Step ST48: The control section 61 issues a left rolling instruction to the electric motor 74 of the rolling drive mechanism 70 and then reverts to step ST02 via the out-connector A4 of FIG. 10 and in-connector A4 of FIG. 7. Namely, the control section 61 issues a control signal for starting the left rolling operation of the auger housing 25 and a control signal for stopping the right rolling operation of the auger housing 25.

Step ST49: The control section 61 issues a stop instruction to the electric motor 74 of the rolling drive mechanism 70 and then reverts to step ST02 via the out-connector A4 of FIG. 10 and in-connector A4 of FIG. 7. Namely, the control section 61 issues a control signal for stopping the left rolling operation of the auger housing 25 and a control signal for stopping the right rolling operation of the auger housing 25.

Figure 11:
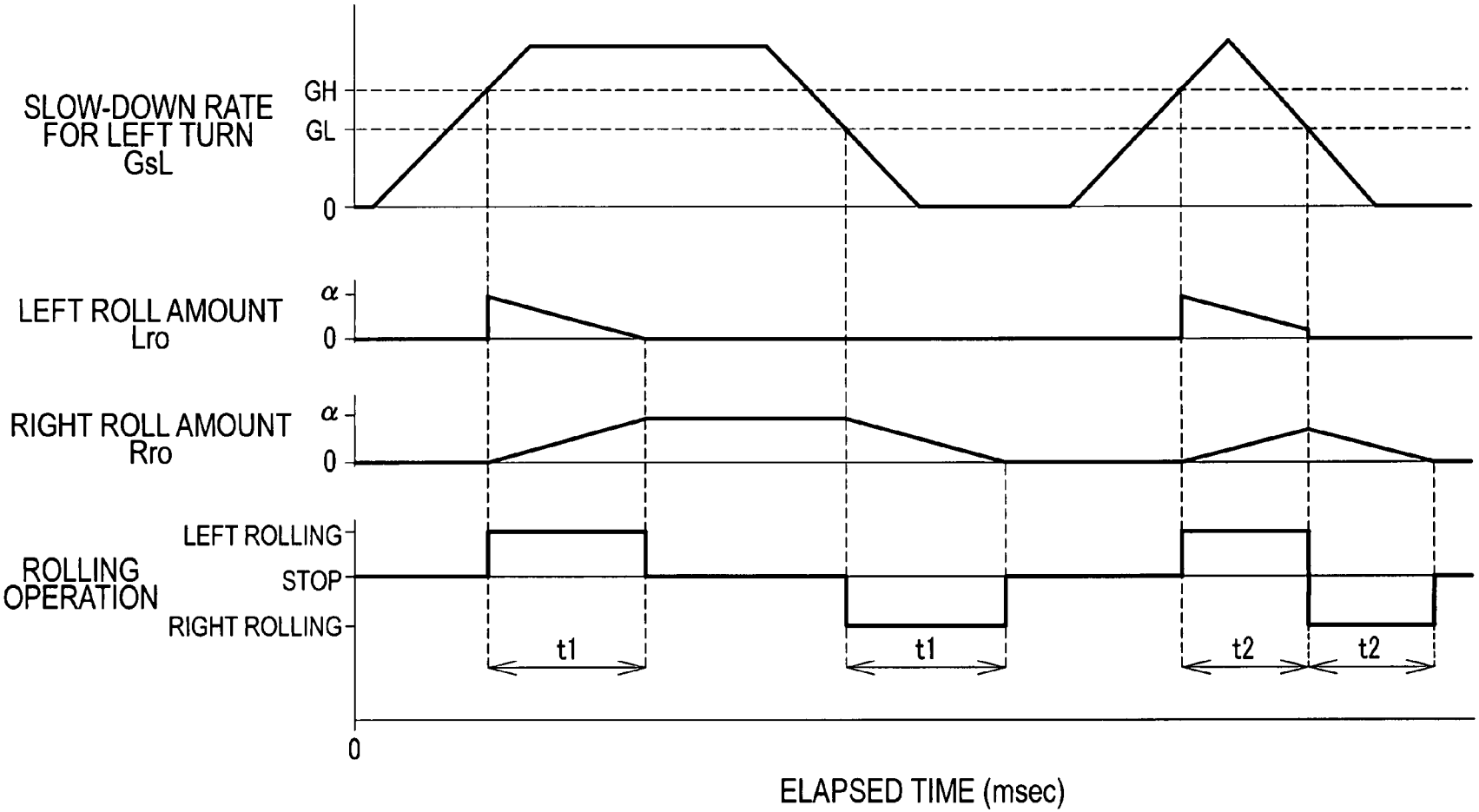
FIG. 11 is a diagram showing behavior of the control section in the snow removing machine of the invention.

FIG. 11 is a diagram showing behavior of the control section 61 employed in the first embodiment of the present invention, which particularly shows relationship among the left slow-down rate GsL, left roll amount Lro, right roll amount Rro and rolling operation of the rolling drive mechanism 70 when the snow removing machine 10 is to be turned left, with the horizontal axis representing an elapsed time.

In left turning of the snow removing machine 10, the left roll amount Lro is set to the value α once the left slow-down rate GsL increases above the great rate threshold value GH, from which time on the predetermined subtraction and addition are successively performed on the left roll amount Lro and right roll amount Rro, respectively, in accordance with the passage of the time, so that the rolling drive mechanism 70 starts rolling the auger housing 25 to the left.

At the beginning of a predetermined time period (e.g., one sec.) t1, the left roll amount Lro starts decreasing while the right roll amount Rro starts increasing, and, at the end of that predetermined time period t1, the decreasing left roll amount Lro reaches zero while the increasing right roll amount Rro reaches the value α, upon which the predetermined subtraction on the left roll amount Lro and the predetermined addition on the right roll amount Rro are terminated and the rolling drive mechanism 70 terminates the left rolling operation. As a result, the auger housing 25 tilts to the left through a predetermined angle.

Then, once the left slow-down rate GsL decreases below the small rate threshold value GL, the predetermined subtraction starts to be successively performed on the right roll amount Rro, in accordance with the passage of the time, so that the rolling drive mechanism 70 starts rolling the auger housing 25 to the right (i.e., back to the neutral position).

At the end of the predetermined time period t1, the decreasing right roll amount Rro reaches the zero level, upon which the predetermined subtraction on the right roll amount Rro is terminated and the rolling drive mechanism 70 terminates the right rolling operation. As a result, the auger housing 25 returns to the original neutral position.

If, in left turning of the snow removing machine 10, a time period t2, from the time point when the left slow-down rate GsL increases above the great rate threshold value GH to the time point when the left slow-down rate GsL decreases below the small rate threshold value GL, is smaller in length than the above-mentioned predetermined time period t1, then the left roll amount Lro does not decrease to the zero level and the right roll amount Rro does not increase to the α level. As a consequence, the auger housing 25 only rolls to the left partway.

Now that the left slow-down rate GsL has decreased below the small rate threshold value GL, the subtraction starts to be performed successively on the right roll amount Rro, in accordance with the passage of the time, until the right roll amount Rro reaches the zero level at the end of the next predetermined time period t2, upon which the subtraction on the right roll amount Rro is terminated and the rolling drive mechanism 70 terminates the right rolling operation. As a result, the auger housing 25 returns to the original neutral position.

As apparent from the foregoing, when the snow removing machine 10 is to be turned to the left rapidly, the human operator increases the slow-down rate of the left running device 11L (FIG. 4) that is located inwardly of the right running device 11R as viewed in the turning direction. Therefore, the left slow-down rate GsL takes a value greater than the great rate threshold value GH (GsL>GH). Thus, in this case, the left turn can be appropriately assisted by the auger housing 25 being rolled to the left into contact with the ground surface.

When the snow removing machine 10 is to be turned to the right rapidly, on the other hand, the right turn can be appropriately assisted by the auger housing 25 being rolled to the right into contact with the ground surface in a similar manner to the left turn.

FIG. 12 is a view explanatory of behavior of the snow removing machine of the present invention, which particularly shows arrangements of the auger housing 25, blower case 26 and rolling drive mechanism 70 as viewed from behind these components 25, 26 and 70.

(a) of FIG. 12 shows the auger housing 25 in the neutral position in a manner corresponding to FIG. 2. As the snow removing machine 10 is turned to the left in this state, the electric motor 74 of the rolling drive mechanism 70 is rotated in the forward direction so that the piston 73 contracts. As a consequence, the auger housing 25 rolls to the left (i.e., counterclockwise as seen in FIG. 12), so that the left sled 28L (i.e., inner side edge of the auger housing 25 as viewed in the leftward turning direction) is caused to contact the ground surface and bite into snow on the ground surface.

Then, the electric motor 74 is rotated in the reverse direction so that the piston 73 expands. As a consequence, the auger housing 25 returns to the original neutral position as illustrated in (a) of FIG. 12.

On the other hand, as the snow removing machine 10 is turned to the right when the auger housing 25 is in the neutral position as illustrated in (a) of FIG. 12, the electric motor 74 of the rolling drive mechanism 70 is rotated in the reverse direction, so that the auger housing 25 rolls to the right (i.e., clockwise as seen in FIG. 12), so that the right sled 28R (i.e., inner side edge of the auger housing 25 as viewed in the rightward turning direction) is caused to contact the ground surface and bite into snow on the ground surface.

The foregoing description may be summed up as follows. As illustrated in FIGS. 4 and 12, the control section 61 issues a drive instruction to the rolling drive mechanism 70 in response to human operator's operation of the left or right turning operator member (left or right turning operation lever 43L or 43R, or left or right turning operation switch 47L or 47R). On the basis of such a drive instruction from the control section 61, the auger housing 25 can be rolled in such a manner as to cause the end portion of one of the side edges (i.e., inner side edge, more specifically, left or right sled 28L or 28R) of the auger housing 25, which is located inwardly of the other (right or left sled 28R or 28L) as viewed in the turning direction, to contact the ground surface biting into a snow surface gr.

With the end portion of the "inner" side edge of the auger housing 25 contacting the ground surface, there is produced a new traveling resistance in the inner side edge of the snow removing machine 10, and thus, the machine 10 can turn about the portion of the side edge contacting the ground surface.

Thus, as the human operator operates any one of the turning operator members, not only one of the running devices 11L or 11R, located inwardly of the other running device 11R or 11L as viewed in the desired turning direction, is slowed down but also the auger housing 25 is rolled in such a manner as to cause the inner side edge to contact the ground surface, which can effectively enhance the turning performance of the snow removing machine 10. Therefore, when the human operator has operated any one of the turning operator members, the snow removing machine 10 can be smoothly switched from the straight travel to the turning travel. As a result, the snow removing machine 10 can be highly maneuverable and usable with ease and, therefore, can efficiently perform snow removal work even in small working areas.

Further, in the snow removing machine 10, as illustrated in FIGS. 3 and 4, the left and right turning operator members in the first embodiment are implemented by the left and right operation levers (left and right turning operation levers 43L and 43R) operable with the same hands holding the grips 18L and 18R fixed to the left and right operating handles 17L and 17R that extend rearwardly from a rear portion of the running-device frame 12. Alternatively, the left and right turning operator members may be implemented by the left turning and right turning push-button switches (left and right turning operation switches 47L and 47R) provided between the operating handles 17L and 17R and at positions within ranges operable by the same hands holding the left and right grips 18L and 18R.

Thus, the human operator can also operate the left and right turning operator members with the two hands while manipulating the snow removing machine 10 with the same hands. Therefore, it is not necessary to rehold or release or let go of any of the left and right grips 18L and 18R each time the human operator performs operation for turning the snow removing machine 10 to the left or right. As a consequence, the present invention can effectively enhance the operability of the snow removing machine 10 and allows the human operator to turn the machine 10 with ease. With such an enhanced turning operability and turning capability of the snow removing machine 10, the overall performance of the machine 10 can be significantly improved.

Further, because only the operation levers or push buttons have to be provided near the left and right operating handles 17L and 17R for purposes of turning the machine 10, the present invention can reduce the number of components necessary to provide the turning operator members and thereby simplify the constructions of the turning operator members.

When the snow removing machine 10 is traveling on a soft ground, such as a snowy ground, the left and/or right running device 11L and/or 11R might get stuck in the ground; in such a case, the left and/or right running device 11L and/or 11R may just run idle digging in the ground.

Further, when the snow removing machine 10 is traveling on a snowy soft ground, for example, the machine 10 may encounter a great resistance ahead due to a great amount and great density of the snow. Where there is a likelihood of the left and/or right running device 11L and/or 11R getting stuck in the snowy soft ground, the human operator of the inventive snow removing machine 10 can break the snow ahead by repetitively rolling the auger housing 25 to the left and/or right (i.e., in the counterclockwise/clockwise direction) by alternately operating the left and right turning operator members with the two hands holding the grips 18L and 18R while manipulating the machine 10 with the same hands. As a consequence, the resistance against forward travel due to the snow in front can be effectively reduced, so that the controllability or maneuverability and traveling performance of the snow removing machine 10 can be even further enhanced.

The following paragraphs describe a modification of the above-described snow removing machine 10 (i.e., snow removing machine according a second embodiment of the present invention), with primary reference to FIGS. 13-19.

The snow removing machine 10 according to the second embodiment is characterized in that the auger-housing-posture manipulating lever itself 52A is equipped with the functions of the left and right turning operator members (left and right turning operation levers 43L and 43R, or left and right turning operation switches 47L and 47R. Thus, in the second embodiment, there is no need to provide the left and right turning operation levers 43L and 43R, or left and right turning operation switches 47L and 47R employed in the above-described first embodiment The other arrangements of the second embodiment are similar to those shown in FIGS. 1-5 and will not be described here to avoid unnecessary duplication.

Figure 13:
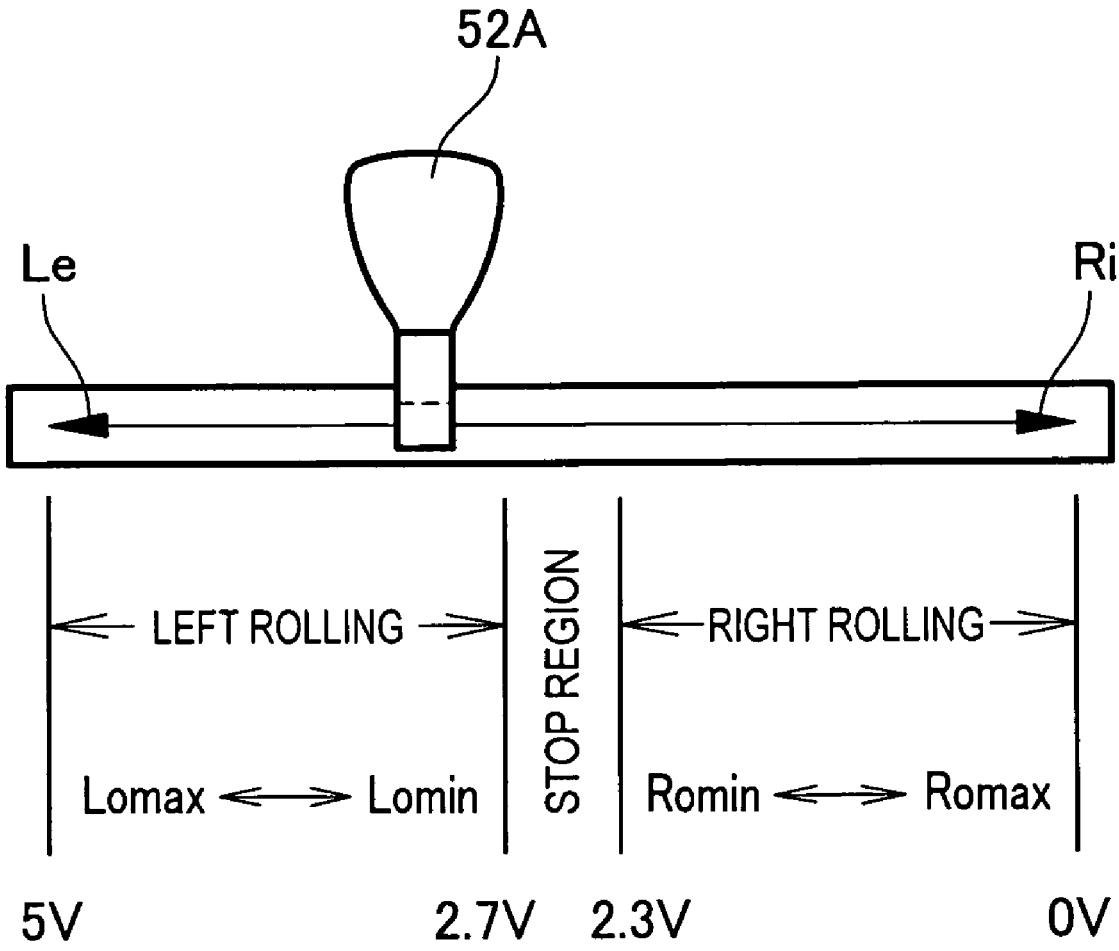
FIG. 13 shows an auger-housing-posture manipulating lever employed in a snow removing machine according to a second embodiment of the invention.

FIG. 13 shows the modified auger-housing-posture manipulating lever 52A employed in the second embodiment. This modified auger-housing-posture manipulating lever 52A is generally similar in construction to the auger-housing-posture manipulating lever 52 shown in FIG. 6, but different therefrom in that it includes a potentiometer provided in place of the left and right rolling switches 93L and 93R.

The modified auger-housing-posture manipulating lever 52A is reciprocatively pivotable by the human operator as indicated by arrows Le and Ri. The auger housing 25 (see FIG. 4) can be rolled to the left (i.e., counterclockwise as viewed from the human operator) by the human operator pivoting the auger-housing-posture manipulating lever 52A to a "left rolling" region from a "stop region" (neutral position), and, in the "left rolling" region, control can be performed on the left rolling between a maximum left rolling operation amount Lomax and a minimum left rolling operation amount Lomin.

Similarly, the auger housing 25 can be rolled to the right (i.e., clockwise as viewed from the human operator) by the human operator pivoting the auger-housing-posture manipulating lever 52A to a "right rolling" region from the "stop region" (neutral position), and, in the "right rolling" region, control can be performed on the right rolling between a maximum right rolling operation amount Romax and a minimum right rolling operation amount Romin.

As indicated in a lower end area of the figure, the potentiometer in the modified auger-housing-posture manipulating lever 52A generates different voltages corresponding to various operating positions of the lever 52A, i.e. 0 V when the lever 52A is at a position corresponding to the maximum right rolling operation amount, 5 V when the lever 52A is at a position corresponding to the maximum left rolling operation amount, and 2.3 V-2.7 V when the lever 52A is in the stop (neutral) region.

Namely, the auger-housing-posture manipulating lever 52A is a rolling operation lever operable to effect left and right (counterclockwise and clockwise) rolling of the auger housing 25. Thus, the auger-housing-posture manipulating lever 52A will hereinafter be referred to also as "rolling operation lever 52A" where appropriate.

The auger-housing-posture manipulating lever 52A is also pivotable in a direction perpendicular to the leftward/rightward pivoting direction indicated by arrows Le and Ri, to cause the auger housing 25 to move in the upward/downward direction (i.e., ascend or descend).

Next, with primary reference to flow charts of FIGS. 14-17, a description will be made about a flow of various control operations performed by the control section 61 in the snow removing machine 10 according to the second embodiment.

Figure 14:
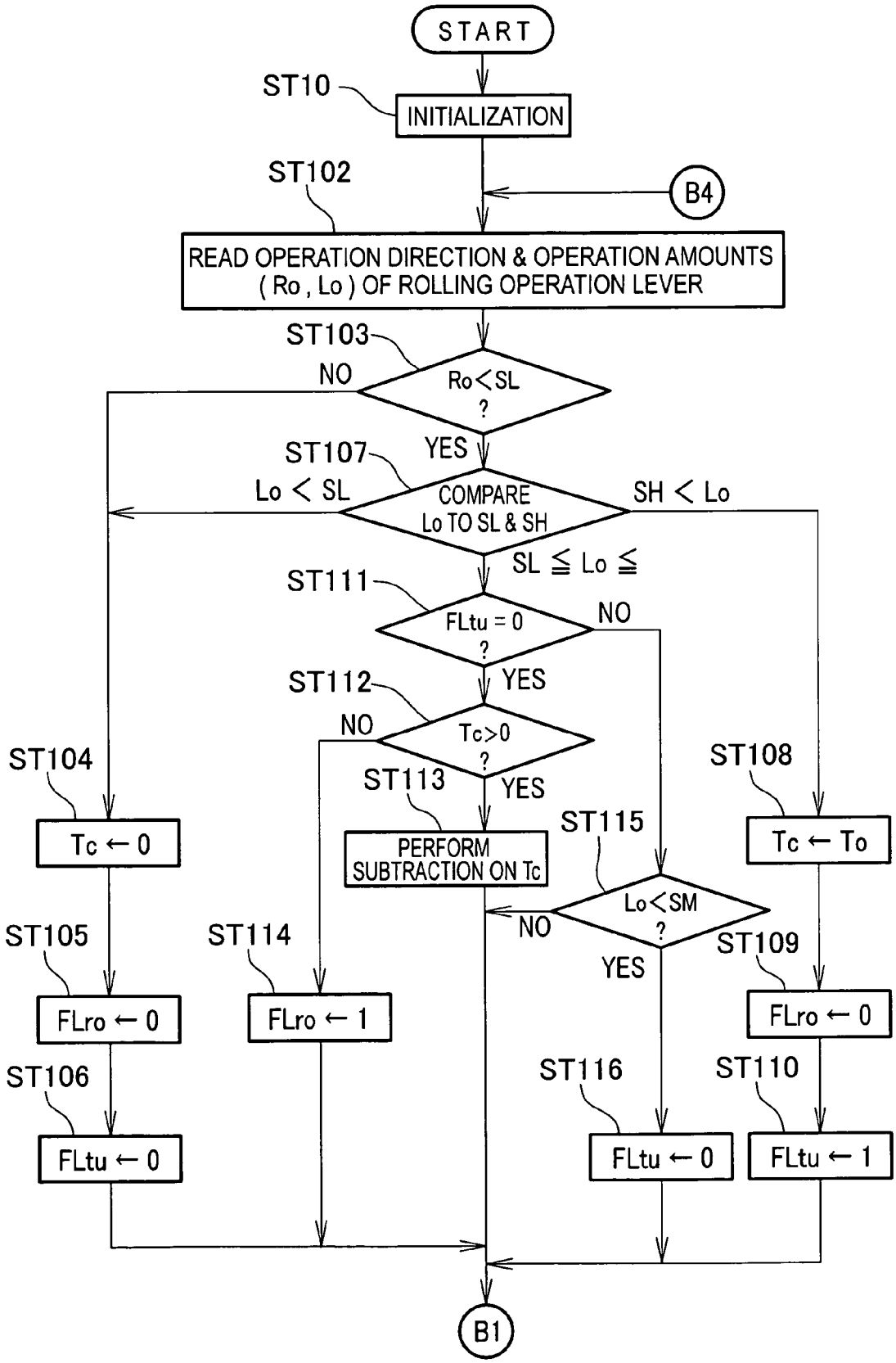
FIG. 14 is a flow chart showing a portion of an example flow of control operations performed by a control section in the second embodiment.

FIG. 14 is a flow chart showing a portion of an example flow of control operations performed by the control section 61 in the second embodiment.

Step ST101: a predetermined initialization process is performed; specifically, various flags, such as a left rolling flag Fro, right rolling flag FRro, left turning flag FLtu, right turning flag FRtu, preceding left turning flag bFLt and preceding right turning flag bFRt, are all set at "0", and a timer-counted time Tc is also set at "0".

Step ST102: The control section 61 reads rolling instructions given from the rolling operation lever 52A, namely, a rolling operation direction and right and left rolling operation amounts Ro and Lo of the rolling operation lever 52A (auger-housing-posture manipulating lever 52A). The rolling operation amounts Ro and Lo are each expressed in percentage (%).

Step ST103: A determination is made as to whether the right rolling operation amount Ro is smaller than a preset small operation-amount threshold value SL (Ro<SL). With a NO determination, the control section 61 branches to step ST104, while, with a YES determination, the control section 61 proceeds to step ST107. The small operation-amount threshold value SL is expressed in percentage (%) and set at, for example, 10% in this case. If the right rolling operation amount Ro is equal to or greater than the preset small operation-amount threshold value SL (NO determination at step ST103), it means that the human operator wants to turn the snow removing machine 10 to the right, so that left rolling control is turned off (canceled).

Step ST104: The control section 61 sets a value "0" as the counted time Tc of the timer contained in the control section 61, and then goes to step ST105.

Step ST105: The left rolling flag FLro is set at "0", and then the control section 61 proceeds to step ST106. The left rolling flag FLro is a flag indicating whether or not the auger housing 25 should be rolled to the left to effectively perform snow removal work.

Step ST106: The left turning flag FLtu is set at "0", and then the control section 61 proceeds to an out-connector B1. The left turning flag FLtu is a flag whether or not the auger housing 25 should be rolled to the left in order to turn the snow removing machine 10 to the left.

Step ST107: The left rolling operation amount Lo is compared to the preset small operation-amount threshold value SL and great operation-amount threshold value SH. The preset great operation-amount threshold value SH, which is greater than the small operation-amount threshold value SL, is expressed in percentage (%) and set at, for example, 60% in this case. If the left rolling operation amount Lo is smaller than the preset small operation-amount threshold value SL (Lo<SL), the control section 61 judges that there has been no intended left rolling operation by the human operator, and branches to step ST104.

If the left rolling operation amount Lo is greater than the preset great operation-amount threshold value SL (SH<Lo), the control section 61 judges that the human operator has operated the rolling operation lever 52A to the left in order to turn the snow removing machine 10 to the left, and branches to step ST108.

If the left rolling operation amount Lo is in the range from the small operation-amount threshold value SL to the great operation-amount threshold value SH (SL≦Lo≦SH), the control section 61 judges that the human operator has operated the rolling operation lever 52A to the left in order to perform snow removal work, and moves on to step ST111.

Step ST108: The control section 61 sets the timer-counted time Tc at a preset predetermined reference time To, and then goes to step ST109.

The reference time To is a slight delay time necessary to invert the value of the left rolling flag FLro from "0" to "1" (see later-described step ST114) after the value of the left turning flag FLtu is inverted from "1" to "0" (see later-described step ST116), and this reference time To is, for example, 100 msec. With the provision of such a delay time, the snow removing machine 10 can be reliably switched from the rolling operation for a left turn to the rolling operation for snow removal work.

Step ST109: The left rolling flag FLro is set at "0", and then the control section 61 proceeds to step ST110.

Step ST110: The left turning flag FLtu is set at "1", and then the control section 61 proceeds to the out-connector B1.

Step ST111: A determination is made as to whether the left turning flag FLtu is currently at the value "0". With a YES determination, the control section 61 proceeds to step ST112, while, with a NO determination, the control section 61 branches to step ST115.

Step ST112: A determination is made as to whether the timer-counted time Tc is greater than "0" (zero). With a YES determination, the control section 61 proceeds to step ST113, while, with a NO determination, the control section 61 branches to step ST114 judging that the reference time To has passed (see later-described step ST108).

Step ST113: Subtraction is performed on the timer-counted time Tc, and then the control section 61 proceeds to the out-connector B1. For example, each time this step is reached, a predetermined time is subtracted from the timer-counted time Tc.

Step ST114: The left rolling flag FLro is set at "1", and then the control section 61 proceeds to the out-connector B1.

Step ST115: A determination is made as to whether the left rolling operation amount Lo is smaller than a preset medium operation-amount threshold value SM (Lo<SM). With a YES determination, the control section 61 proceeds to step ST116, while, with a NO determination, the control section 61 proceeds to the out-connector B1. The medium operation-amount threshold value SM, which is greater than the small operation-amount threshold value SL, is expressed in percentage (%) and set at, for example, 40% in this case.

If (Lo<SM), it means that the human operator has stopped left turning operation. In this way, a hysteresis characteristic is imparted to the medium operation-amount threshold value SM, used for terminating the turning operation, with respect to the great operation-amount threshold value used for starting the turning operation.

Step ST116: The left turning flag FLtu is set at "0", and then the control section 61 proceeds to the out-connector B1.

Figure 15:
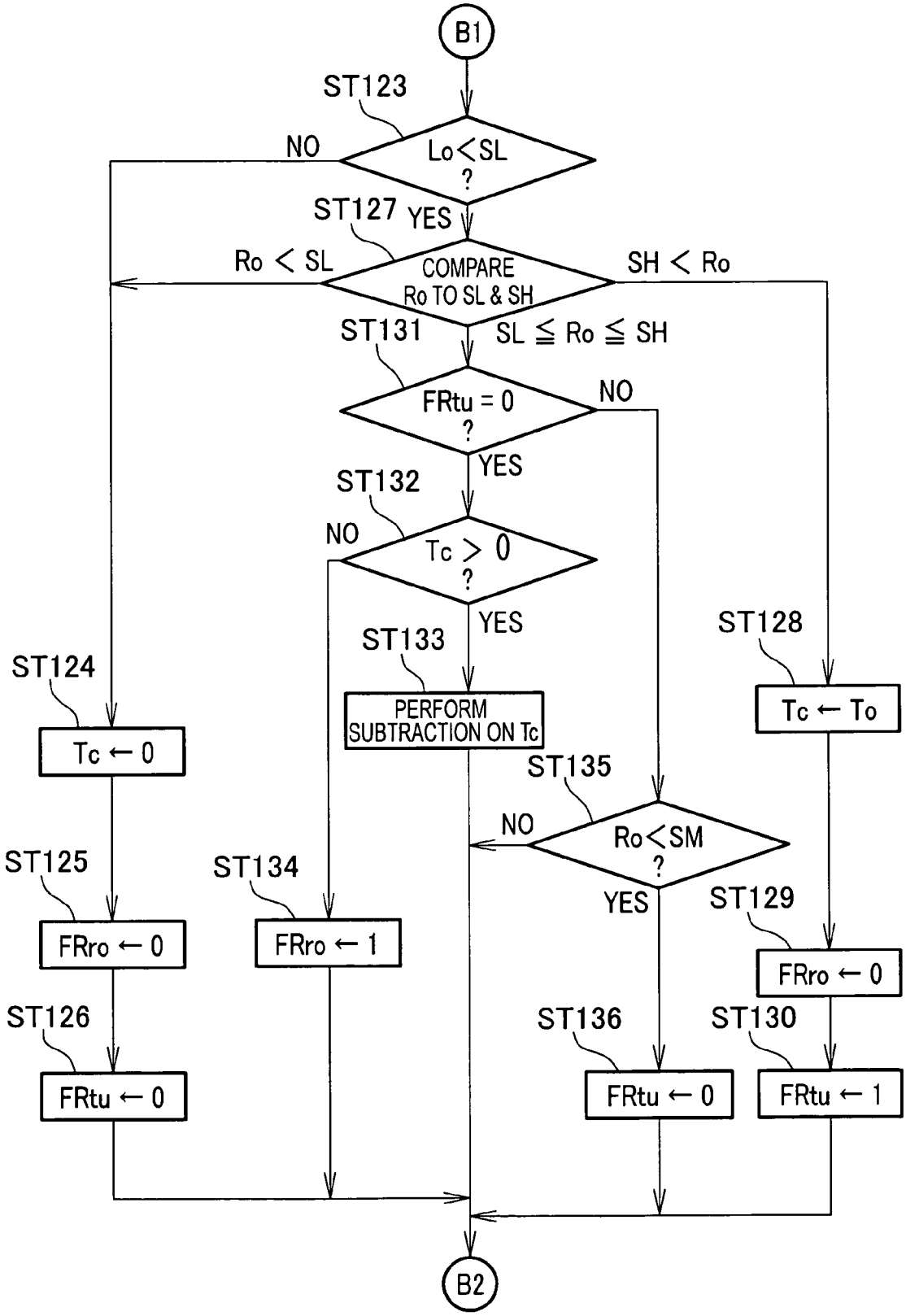
FIG. 15 is a flow chart showing another portion of the example flow of control operations performed by the control section in the second embodiment.

FIG. 15 is a flow chart showing another portion of the example flow of control operations performed by the control section 61 in the second embodiment.

Step ST123: A determination is made as to whether the left rolling operation amount Lo is smaller than the preset small operation-amount threshold value SL (Lo<SL). With a NO determination, the control section 61 branches to step ST124, while, with a YES determination, the control section 61 proceeds to step ST127. If the right rolling operation amount Ro is equal to or greater than the preset small operation-amount threshold value SL (NO determination at step ST123), it means that the human operator wants to turn the snow removing machine 10 to the left, so that right rolling control is turned off (canceled).

Step ST124: The control section 61 sets a value "0" as the counted time Tc of the timer, and then goes to step ST125.

Step ST125: The right rolling flag FRro is set at "0", and then the control section 61 proceeds to step ST126. The right rolling flag FRro is a flag indicating whether or not the auger housing 25 should be rolled to the right to effectively perform snow removal work.

Step ST126: The right turning flag FRtu is set at "0", and then the control section 61 proceeds to an out-connector B2. The right turning flag FRtu is a flag whether or not the auger housing 25 should be rolled to the right in order to turn the snow removing machine 10 to the right.

Step ST127: The right rolling operation amount Ro is compared to the preset small operation-amount threshold value SL and great operation-amount threshold value SH.

If the right rolling operation amount Ro is smaller than the preset small operation-amount threshold value SL (Ro<SL), the control section 61 judges that there has been no intended right rolling operation by the human operator, and branches to step ST124.

If the right rolling operation amount Ro is greater than the preset great operation-amount threshold value SH (SH<Ro), the control section 61 judges that the human operator has operated the rolling operation lever 52A to the right in order to turn the snow removing machine 10 to the right, and branches to step ST128.

If the right rolling operation amount Ro is in the range from the small operation-amount threshold value SL to the great operation-amount threshold value SH (SL≦Ro≦SH), the control section 61 judges that the human operator has operated the rolling operation lever 52A to the right in order to perform snow removal work, and moves on to step ST131.

Step ST128: The control section 61 sets the timer-counted time Tc at a preset reference time To, and then goes to step ST129. Similarly to the preset reference time To explained above in relation to step ST108, this reference time To is a slight delay time necessary to invert the value of the right rolling flag FRro from "0" to "1" after the value of the right turning flag FRtu is inverted from "1" to "0".

Step ST129: The right rolling flag FRro is set at "0", and then the control section 61 proceeds to step ST130.

Step ST130: The right turning flag FRtu is set at "1", and then the control section 61 proceeds to the out-connector B2.

Step ST131: A determination is made as to whether the right turning flag FRtu is currently at the value "0". With a YES determination, the control section 61 proceeds to step ST132, while, with a NO determination, the control section 61 branches to step ST135.

Step ST132: A determination is made as to whether the timer-counted time Tc is greater than "0" (zero). With a YES determination, the control section 61 proceeds to step ST133, while, with a NO determination, the control section 61 branches to step ST134 judging that the reference time To has passed (see later-described step ST128).

Step ST133: Subtraction is performed on the timer-counted time Tc, and then the control section 61 proceeds to the out-connector B2. For example, each time this step is reached, a predetermined time is subtracted from the timer-counted time Tc.

Step ST134: The right rolling flag FRro is set at "1", and then the control section 61 proceeds to the out-connector B2.

Step ST135: A determination is made as to whether the right rolling operation amount Ro is smaller than the preset medium operation-amount threshold value SM (Ro<SM). With a YES determination, the control section 61 proceeds to step ST136, while, with a NO determination, the control section 61 proceeds to the out-connector B2.

Step ST136: The right turning flag FRtu is set at "0", and then the control section 61 proceeds to the out-connector B2.

Figure 16:
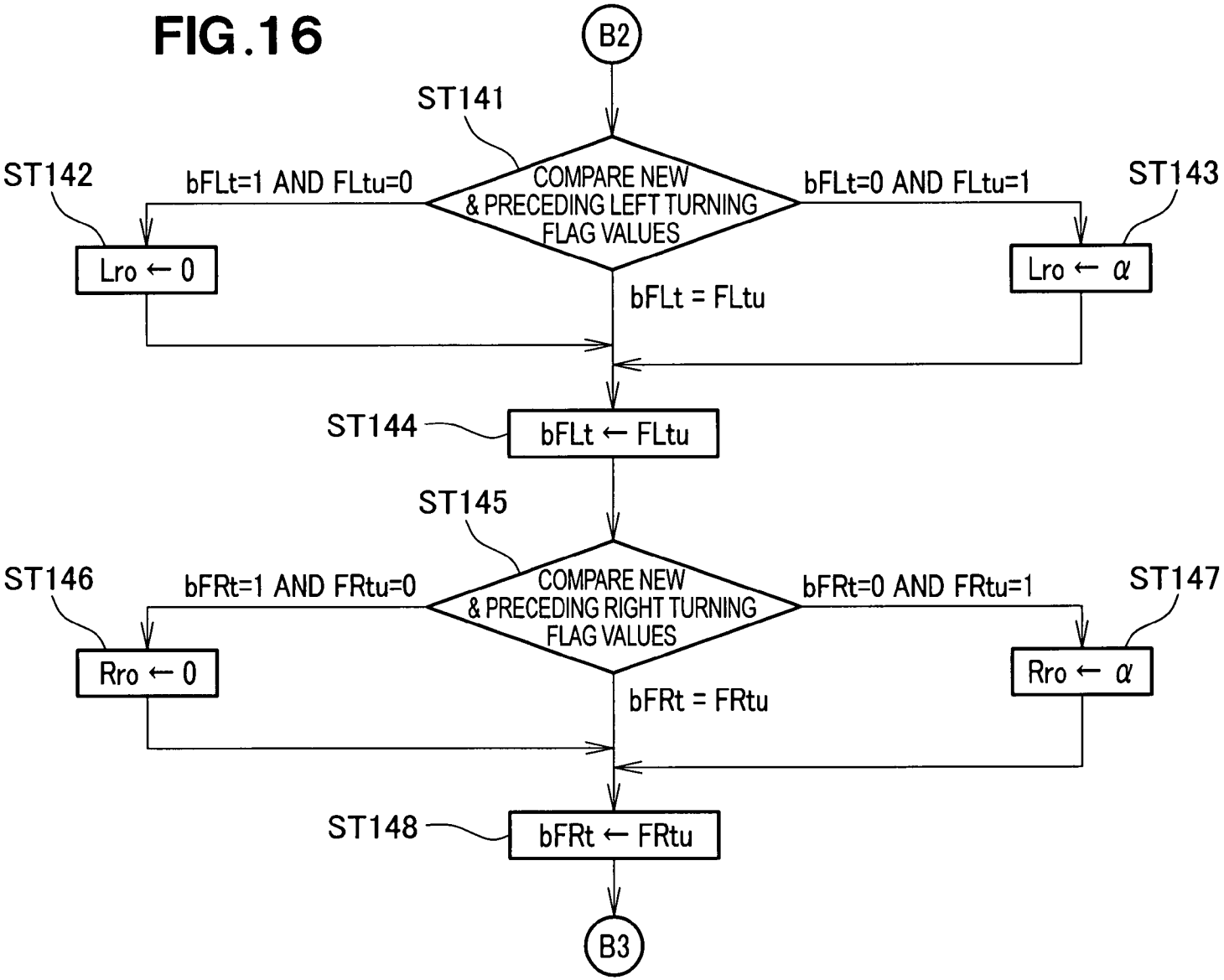
FIG. 16 is a flow chart showing still another portion of the example flow of control operations performed by the control section in the second embodiment.

FIG. 16 is a flow chart showing still another portion of the example flow of control operations performed by the control section 61 in the second embodiment.

Step ST141: Newest value of the left turning flag FLtu hereinafter "new left turning flag value FLtu") is compared to the previous value of the left turning flag FLtu (hereinafter "preceding left turning flag value bFLt"). If the preceding left rolling flag value bFLt is "1" and new left turning flag value FLtu is "0", the control section 61 judges that left rolling of the auger housing 25 responsive to turning operation is to be terminated and goes to step ST142. If the preceding left turning flag value bFLt is "0" and new left rolling flag value FLtu is "1", the control section 61 judges that left rolling of the auger housing 25 is to be started in response to leftward turning operation and goes to step ST143. If the new left turning flag value FLtu agrees with the preceding left turning flag value bFLt, the control section 61 judges that the current state is to be maintained and goes to step ST144.

Step ST142: The left roll amount Lro is set to "0", and then the control section 61 proceeds to step ST144.

Step ST143: The left roll amount Lro is set to α, and then the control section 61 proceeds to step ST144. As explained above in relation to step ST23, "α" represents a predetermined roll amount in a range for rolling the auger housing 25 from the neutral position, and is set, for example, at a values that causes an end portion of the "inner" side edge, as viewed in the turning direction, of the auger housing 25 (sled 28L or 28R) to contact the ground surface.

Step ST144: The preceding left turning flag value bFLt is rewritten with the new left rolling flag value FLro, and then the control section 61 goes to step ST145.

Step ST145: Newest value of the right turning flag FRtu (hereinafter "new left turning flag value FRtu") is compared to the preceding value of the right turning flag bFRt (hereinafter "preceding right turning flag value bFRt"). If the preceding turning flag value bFRt is "1" and new right turning flag value FRtu is "0", the control section 61 judges that right rolling of the auger housing 25 responsive to turning operation is to be terminated and goes to step ST146. If the preceding right turning flag value bFRt is "0" and new right turning flag value FRtu is "1", the control section 61 judges that right rolling of the auger housing 25 is to be started in response to turning operation and goes to step ST147. If the new right turning flag value FRtu agrees with the preceding right turning flag value bFRt, the control section 61 judges that the current state is to be maintained and goes to step ST148.

Step ST146: The right roll amount Rro is set to "0", and then the control section 61 proceeds to step ST148.

Step ST147: The right roll amount Rro is set to α, and then the control section 61 proceeds to step ST148. "α" represents the same predetermined roll amount as used at step ST143 above.

Step ST148: The preceding right turning flag value bFRt is rewritten with the new right turning flag value FRtu, and then the control section 61 goes to an out-connector B3.

Figure 17:
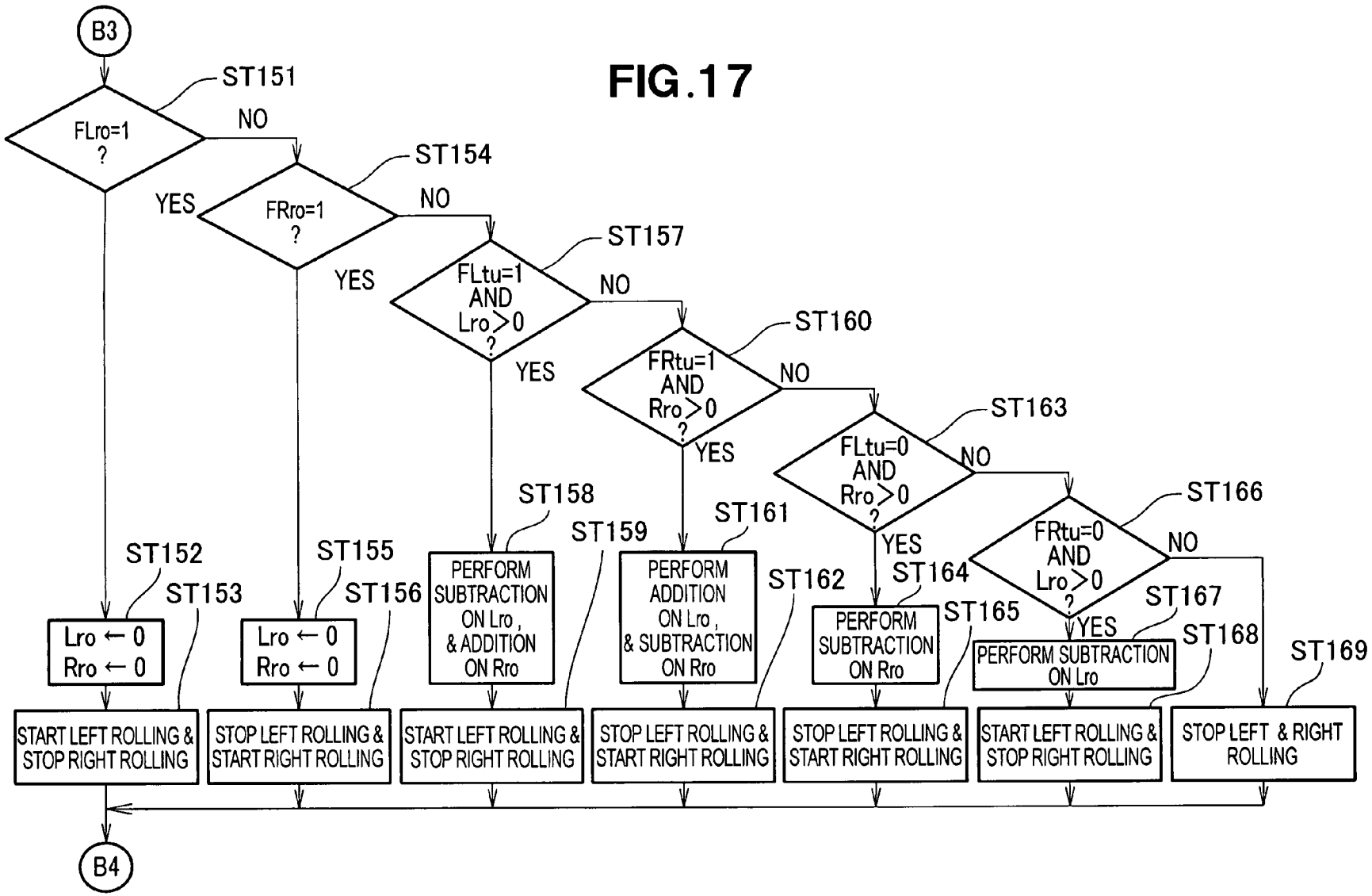
FIG. 17 is a flow chart showing the remaining portion of the example flow of control operations performed by the control section in the second embodiment.

FIG. 17 is a flow chart showing the remaining portion of the flow of control operations performed by the control section 61 in the second embodiment.

Step ST151: A determination is made as to whether the value of the left rolling flag FLro is "1" or not. With a YES determination, the control section 61 proceeds to step ST152, while, with a NO determination, the control section 61 branches to step ST154.

Step ST152: The left and right roll amounts Lro and Rro are each set to "0", and then the control section 61 proceeds to step ST153.

Step ST153: The control section 61 issues a left rolling instruction to the electric motor 74 of the rolling drive mechanism 70 and then reverts to step ST102 by way of an out-connector B4 of FIG. 17 and in-connector B4 of FIG. 14. Namely, the control section 61 issues a control signal for starting the left rolling operation of the auger housing 25 and a control signal for stopping the right rolling operation of the auger housing 25. In this way, the auger housing 25 is caused to roll to the left while the human operator is operating the auger-housing-posture manipulating lever 52A to effect snow removal work.

Step ST154: A determination is made as to whether the value of the right rolling flag FRro is "1" or not. With a YES determination, the control section 61 proceeds to step ST155, while, with a NO determination, the control section 61 branches to step ST157.

Step ST155: The left and right roll amounts Lro and Rro are each set to "0", and then the control section 61 proceeds to step ST156.

Step ST156: The control section 61 issues a right rolling instruction to the electric motor 74 of the rolling drive mechanism 70 and then reverts to step ST102 by way of the out-connector B4 of FIG. 17 and in-connector B4 of FIG. 14. Namely, the control section 61 issues a control signal for stopping the left rolling operation of the auger housing 25 and a control signal for starting the right rolling operation of the auger housing 25. In this way, the auger housing 25 is caused to roll to the right while the human operator is operating the auger-housing-posture manipulating lever 52A to effect snow removal work.

Step ST157: A determination is made as to whether the value of the left turning flag FLtu is "1" and the left roll amount Lro is greater than "0" (i.e., FLtu=1 and Lro>0). If answered in the affirmative, the control section 61 judges that left rolling is to be effected for a left turn of the machine 10 and moves on to step ST158, while, if answered in the negative, the control section 61 branches to step ST160.

Step ST158: Subtraction is performed on the left roll amount Lro while an addition is performed on the right roll amount Rro, and then the control section 61 proceeds to step ST159. For example, each time this step is reached, a predetermined very small amount is subtracted from the left roll amount Lro while the predetermined very small amount is added to the right roll amount Rro.

Step ST159: The control section 61 issues a left rolling instruction to the electric motor 74 of the rolling drive mechanism 70 and then reverts to step ST02 via the out-connector B4 of FIG. 17 and in-connector B4 of FIG. 14. Namely, the control section 61 issues a control signal for starting the left rolling operation of the auger housing 25 and a control signal for stopping the right rolling operation of the auger housing 25.

Step ST160: A determination is made as to whether the value of the right turning flag FRtu is "1" and the right roll amount Rro is greater than "0" (i.e., FRtu=1 and Rro>0). If answered in the affirmative, the control section 61 judges that right rolling is to be effected for a right turn of the machine 10 and moves on to step ST161, while, if answered in the negative, the control section 61 branches to step ST163.

Step ST161: Addition is performed on the left roll amount Lro while a subtraction is performed on the right roll amount Rro, and then the control section 61 proceeds to step ST162. For example, each time this step is reached, a predetermined very small amount is added to the left roll amount Lro while the predetermined very small amount is subtracted from the right roll amount Rro.

Step ST162: The control section 61 issues a right rolling instruction to the electric motor 74 of the rolling drive mechanism 70 and then reverts to step ST02 via the out-connector B4 of FIG. 17 and in-connector B4 of FIG. 14. Namely, the control section 61 issues a control signal for stopping the left rolling operation of the auger housing 25 and a control signal for starting the right rolling operation of the auger housing 25.

Step ST163: A determination is made as to whether the value of the left turning flag FLtu is "0" and the right roll amount Rro is greater than "0" (i.e., FLtu=0 and Rro>0). If answered in the affirmative, the control section 61 judges that right rolling is to be effected to return the auger housing 25 to the original neutral position and moves on to step ST164, while, if answered in the negative, the control section 61 branches to step ST166.

Step ST164: Subtraction is performed on the right roll amount Rro, and then the control section 61 proceeds to step ST165. For example, each time this step is reached, a predetermined very small amount is subtracted from the right roll amount Rro.

Step ST165: The control section 61 issues a right rolling instruction to the electric motor 74 of the rolling drive mechanism 70 and then reverts to step ST02 via the out-connector B4 of FIG. 17 and in-connector B4 of FIG. 14. Namely, the control section 61 issues a control signal for stopping the left rolling operation of the auger housing 25 and a control signal for starting the right rolling operation of the auger housing 25.

Step ST166: A determination is made as to whether the value of the right turning flag FRtu is "0" and the left roll amount Lro is greater than "0" (i.e., FRtu=0 and Lro>0). If answered in the affirmative, the control section 61 judges that left rolling is to be effected to return the auger housing 25 to the original neutral position and moves on to step ST167, while, if answered in the negative, the control section 61 branches to step ST169.

Step ST167: Subtraction is performed on the left roll amount Lro, and then the control section 61 proceeds to step ST168. For example, each time this step is reached, a predetermined very small amount is subtracted from the left roll amount Lro.

Step ST168: The control section 61 issues a left rolling instruction to the electric motor 74 of the rolling drive mechanism 70 and then reverts to step ST102 via the out-connector B4 of FIG. 17 and in-connector B4 of FIG. 14. Namely, the control section 61 issues a control signal for starting the left rolling operation of the auger housing 25 and a control signal for stopping the right rolling operation of the auger housing 25.

Step ST169: The control section 61 issues a stop instruction to the electric motor 74 of the rolling drive mechanism 70 and then reverts to step ST102 via the out-connector B4 of FIG. 17 and in-connector B4 of FIG. 14. Namely, the control section 61 issues a control signal for stopping the left and right rolling operation of the auger housing 25.

Figure 18:
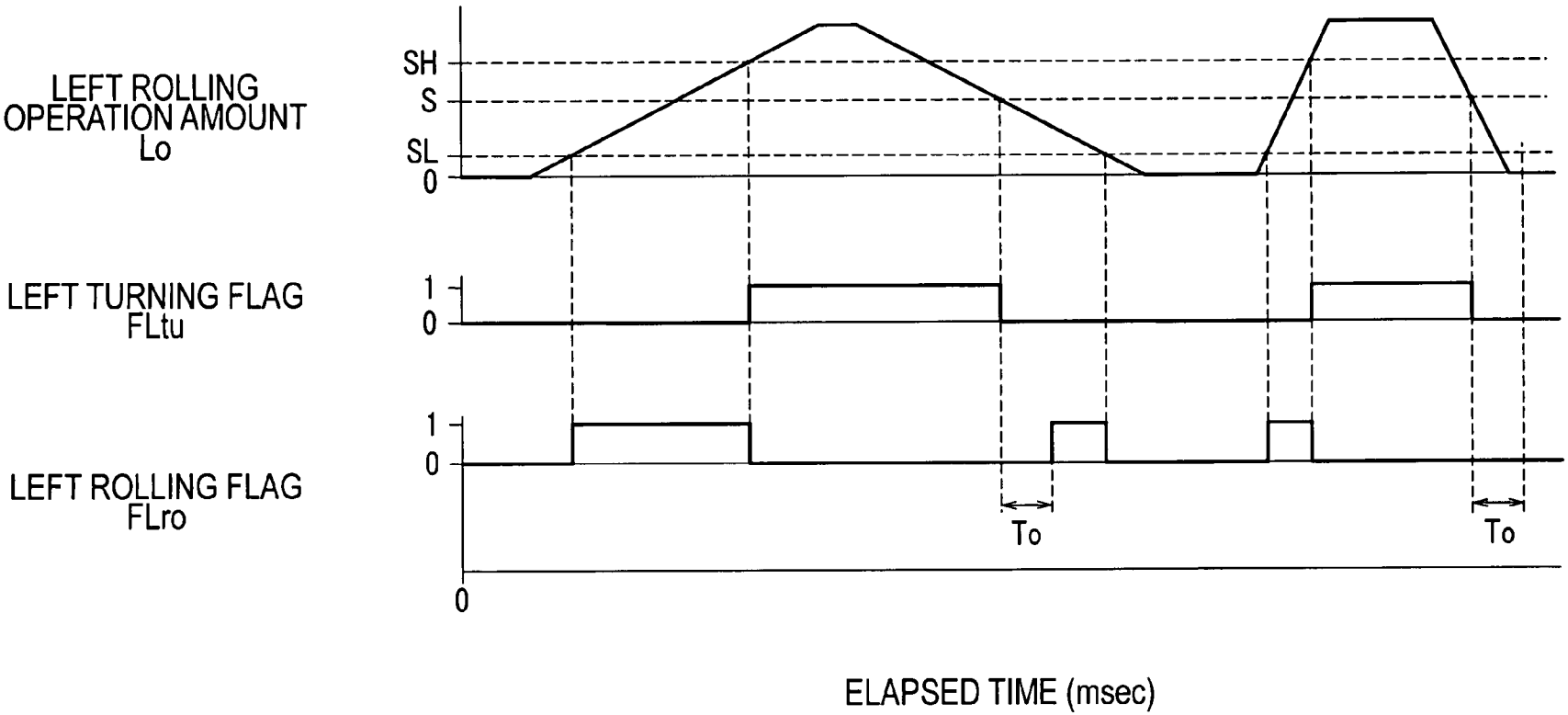
FIG. 18 is a diagram showing behavior of the control section in the second embodiment.

FIG. 18 is a diagram showing behavior of the control section 61 employed in the second embodiment, which particularly shows relationship among the left rolling operation amount Lo, left turning flag FLtu and left rolling flag FLro, right roll amount Rro and rolling operation of the rolling drive mechanism 70 when the snow removing machine 10 is to be turned left, with the horizontal axis representing the elapsed time.

In left turning of the second embodiment, once the left rolling operation amount Lo increases above the preset small operation-amount threshold value SL, the value of the left rolling flag FLro is inverted from "0" to "1". Then, once the left rolling operation amount Lo further increases to exceed the great operation-amount threshold value SH, the value of the left rolling flag FLro is inverted from "1" to "0" and the value of the left turning flag FLtu is inverted from "0" to "1". Then, the value of the left turning flag FLtu is inverted from "1" to "0" once the left rolling operation amount Lo decreases below the medium operation-amount threshold value SM. Then, the value of the left tolling flag FLro is inverted from "0" to "1" upon passage of the slight reference time To from the time point when the left rolling operation amount Lo has decreased below the medium operation-amount threshold value SM. Thence, once the left rolling operation amount Lo further decreases to fall below the small operation-amount threshold value SL, the value of the left rolling flag FLro is inverted from "1" to "0".

Further, if, in left turning of the machine 10, the left rolling operation amount Lo increases above the great operation-amount threshold value SH and then decreases past the medium operation-amount threshold value SM to fall below the small operation-amount threshold value SL before the passage of the following reference time To, the value of the left rolling flag FLro is left unchanged from "0".

Figure 19:
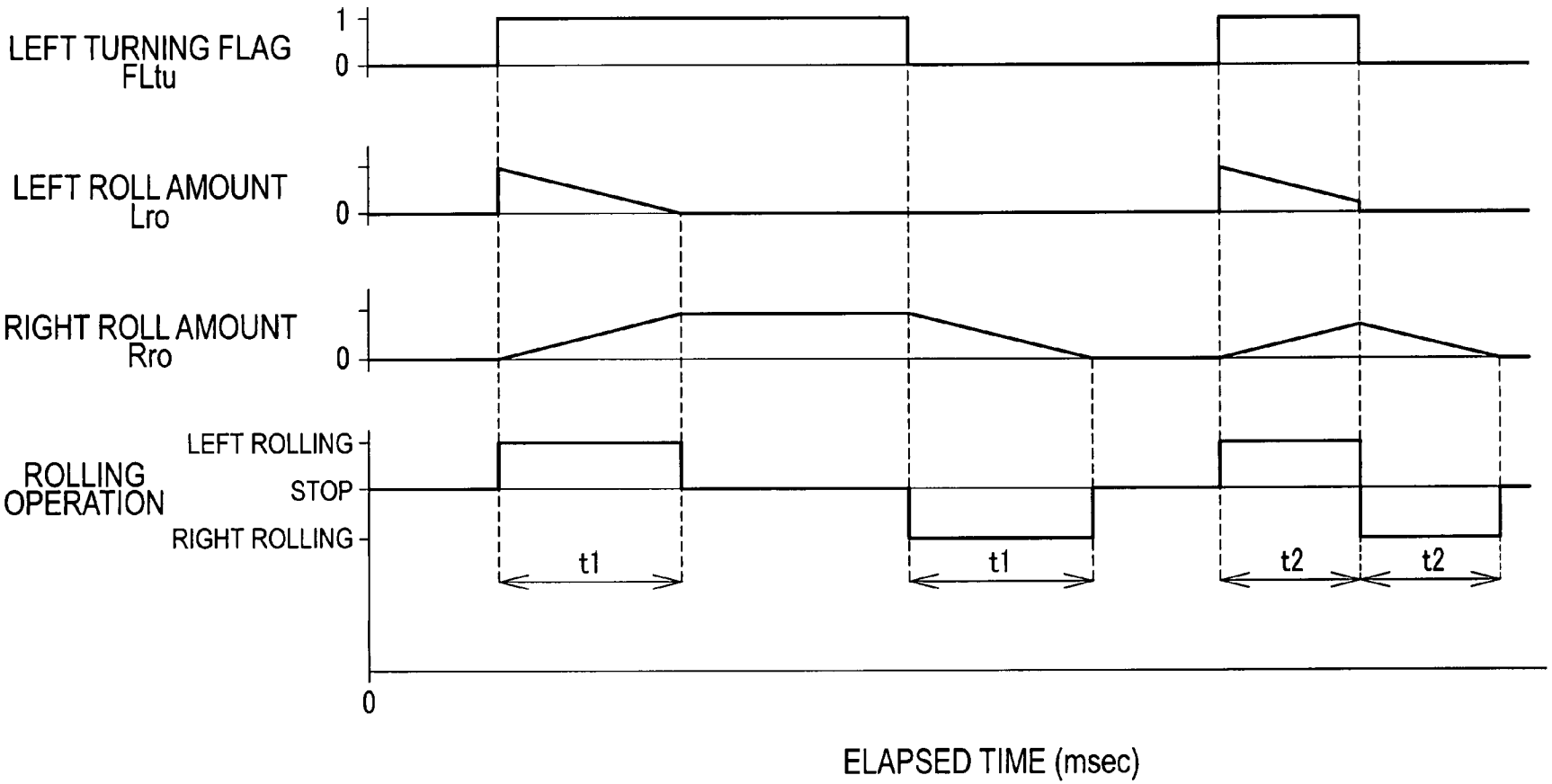
FIG. 19 is also a diagram showing the behavior of the control section in the second embodiment.
Figure 20:
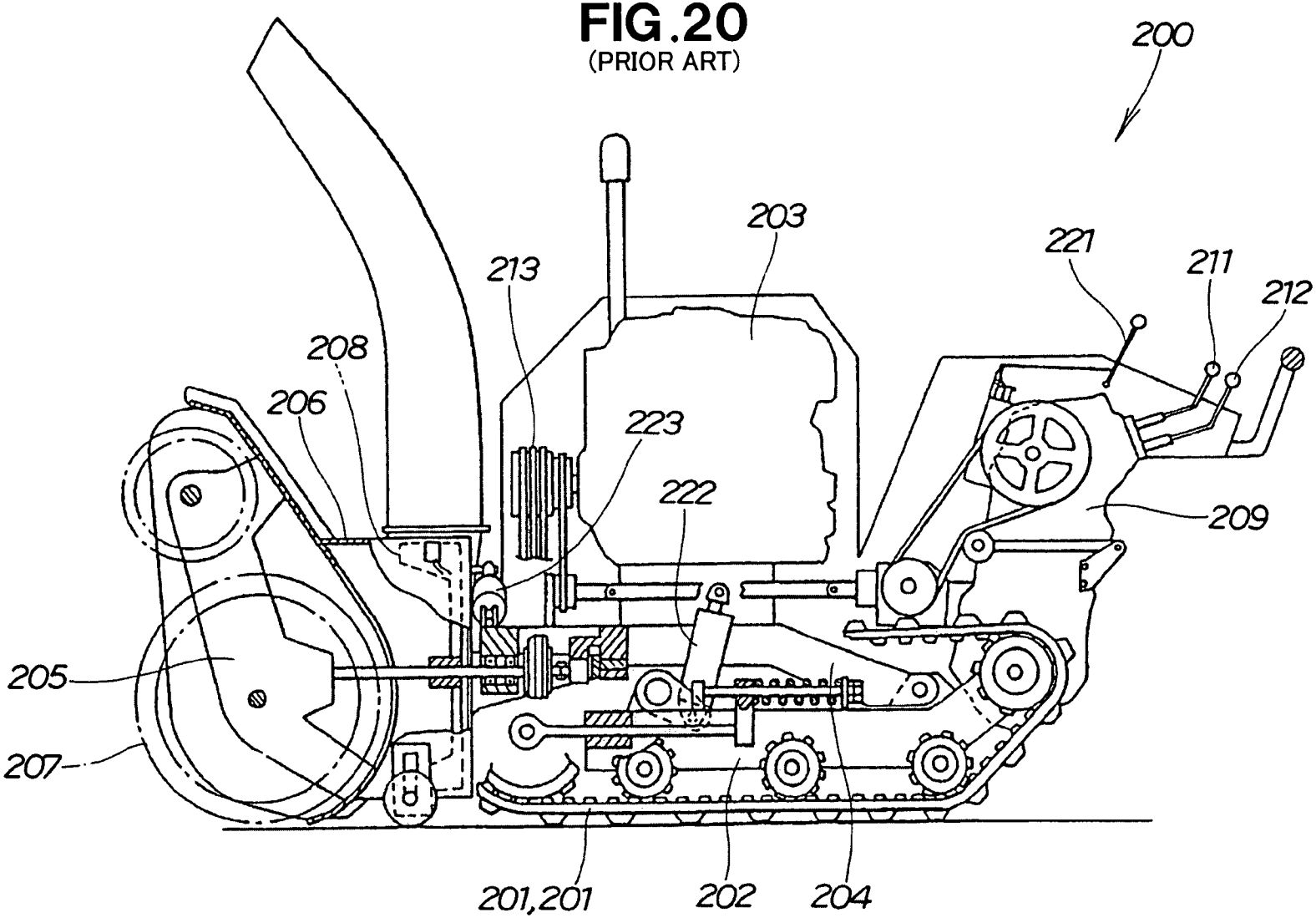
FIG.20 (PRIOR ART)
FIG. 20 is a side view of a conventionally-known auger-type snow removing machine.

FIG. 19 is another diagram showing the behavior of the control section 61 employed in the second embodiment, which particularly shows relationship among the left turning flag FLtu, left roll amount Lro, right roll amount Rro and rolling operation of the rolling drive mechanism 70, with the horizontal axis representing the elapsed time.

In left turning of the second embodiment, once the value of the left turning flag FLtu is inverted from "0" to "1", the left roll amount Lro is set to "α", from which time on the predetermined subtraction and addition are successively performed on the left roll amount Lro and right roll amount Rro, respectively, in accordance with the passage of the time, so that the rolling drive mechanism 70 starts rolling the auger housing 25 to the left.

At the end of a predetermined time period t1, the decreasing left roll amount Lro reaches "0" while the increasing right roll amount Rro reaches "α", upon which the predetermined subtraction on the left roll amount Lro and the predetermined addition on the right roll amount Rro are terminated and the rolling drive mechanism 70 stops rolling the auger housing 25. As a result, the auger housing 25 tilts to the left through a predetermined angle.

Then, once the value of the left turning flag FLtu is inverted from "1" to "0", the subtraction starts to be performed successively on the right roll amount Rro, in accordance with the passage of the time, and the rolling drive mechanism 70 starts rolling the auger housing 25 to the right (returning the auger housing 25 to the neutral position). At the end of the following predetermined time period t1, the decreasing right roll amount Rro reaches "0", upon which the predetermined subtraction on the right roll amount Rro is terminated and the rolling drive mechanism 70 stops rolling the auger housing 25. As a result, the auger housing 25 returns to the original neutral position.

If, in left turning of the snow removing machine 10, a time period t2 when the value of the left turning flag FLtu is kept at "1", is shorter than the above-mentioned predetermined time period t1, then the left roll amount Lro does not decrease to the zero level and the right roll amount Rro does not increase to the α level. As a consequence, the auger housing 25 only rolls to the left partway.

Starting at the time point when the left turning flag FLtu has been inverted from "1" to "0", the predetermined subtraction is performed successively on the right roll amount Ryo, in accordance with the passage of the time, until the right roll amount Ryo decreases to the zero level at the end of the predetermined time period t2. When the right roll amount Ryo has decreased to the zero level, the predetermined subtraction on the right roll amount Ryo is terminated, and the rolling drive mechanism 70 stops rolling the auger housing 25. As a result, the auger housing 25 returns to the original neutral position.

When the snow removing machine 10 is to be turned to the right, the control section 61 performs control to allow the auger housing 25 to be rolled to the right in generally the same manner as when the snow removing machine 10 is to be turned to the left.

As apparent from the foregoing, the second embodiment can achieve the following novel advantageous results as well as those attained by the first embodiment of FIGS. 1-12.

Namely, in the second embodiment, the auger-housing-posture manipulating lever 52A, which fundamentally operates the rolling drive mechanism 70 for rolling the auger housing 25 in accordance with the snow surface during snow removal work using the auger 31, is designed to function also as the turning operator member. Thus, in this case, there is no need to provide separate turning operation levers on the machine 10.

More specifically, three operation-amount threshold values SL, SM and SH are set in the second embodiment. The rolling operation amounts Lo and Ro of the auger-housing-posture manipulating lever 52A are compared to the three operation-amount threshold values SL, SM and SH, so that, with the auger-housing-posture manipulating lever 52A alone, the human operator can perform both (1) auger-housing rolling operation to assist turning of the machine 10 and (2) auger-housing rolling operation to assist snow removal work.

Even though the snow removing machine 10 according to the second embodiment of the invention has no dedicated turning operator member, the human operator can use the auger-housing-posture manipulating lever 52A to readily perform operation for turning the machine 10. Thus, the second embodiment can achieve an enhanced turning operability, sufficient turning performance and hence enhanced overall performance of the snow removing machine 10. Since the number of necessary operation members can be minimized, the basic principles of the second embodiment can be suitably applicable to snow removing machines that have to be small in size or have other spatial limitations. Further, because the number of necessary components can be reduced, the second embodiment can reduce the manufacturing cost of the snow removing machine 10.

The snow removing machine 10 of a type where the left and right running devices 11L and 11R are not controlled independently of each other can not make a turn by slowing down one of the running devices. Thus, normally, the snow removing machine 10 has to be turned by the human operator displacing the machine manually by his or her own force. With the second embodiment, however, the human operator can operate the auger-housing-posture manipulating lever 52A to roll the auger housing 25, in a direction corresponding to a desired turning direction of the snow removing machine 10, so as to cause the end portion of one of the side edges of the auger housing 25, located inwardly of the other side edge as viewed in the turning direction, to contact the ground surface. Thus, the snow removing machine 10 can be appropriately turned with the portion of the ground-contacting inner side edge as a pivot center.

Because the left and right running devices 11L and 11R are not controlled independently of each other, the cost of the machine 10 can be lowered. Further, because any one of the left and right running devices 11L and 11R is not slowed down in turning the snow removing machine 10, a sufficiently-great force for running the machine 10 can always be secured reliably.

Driving sources for the running devices 11L and 11R may be other than the electric motors 21L and 21R. For example, the engine 14 may be used as the driving source for the running devices 11L and 11R, in which case the output power of the engine 14 is transmitted, via a hydrostatic continuously variable transmission, to the running devices 11L and 11R. The hydrostatic continuously variable transmission is a well-known continuously variable transmission capable of rotating left and right output shafts in forward and reverse directions and stopping the rotations of the output shafts, independently of each other, in response to power received via input shafts.

Further, each of the auger housing elevator mechanism 16 and rolling drive mechanism 70 may be other than the electric hydraulic cylinder of the type that expands and contracts the piston with hydraulic pressure produced from the hydraulic pump by the electric motor integrally fixed to the cylinder; for example, it may comprise a combination of a hydraulic device and hydraulic cylinder provided separately from each other.

Further, the above-mentioned predetermined time t1 is a time period over which the left or right roll amount Lro or Rro decreases from the "$\alpha$" level to the "0" level; namely, the predetermined time t1 corresponds to the predetermined roll amount $\alpha$. Thus, the predetermined roll amount $\alpha$ may be replaced with the predetermined time t1.

Furthermore, the determination as to whether the left or right roll amount Lro or Rro has decreased from the "$\alpha$" level to the "0" level may be made on the basis of an output from a position sensor that detects a roll amount of the auger housing 25, instead of the subtraction and addition of the predetermined roll amount $\alpha$ or the passage of time.

Furthermore, when the auger housing 25 is already in a position rolled partway, the predetermined roll amount $\alpha$ may be subtracted a predetermined number of times corresponding to the partway-rolled position (e.g., step ST23 or T27 of FIG. 9). Thus, when the snow removing machine 10 is to be turned, the auger housing 25 may be rolled only by an amount necessary to assist the turning.

In the snow removing machine 10 according to the second embodiment, rolling operation via the auger-housing-posture manipulating lever 52A may be dispensed with, and the functions of the auger-housing-posture manipulating lever 52A may be performed by turning operator members (e.g., left and right turning operation levers 43L and 43R or left and right turning operation switches 47L and 47R). In such a case, only the left and right turning operation levers or the left and right turning operation switches can perform both (1) auger-housing rolling operation to assist turning of the machine 10 and (2) auger-housing rolling operation to assist snow removal work.

Further, in the snow removing machine 10 according to the second embodiment, the auger-housing rolling operation to assist turning of the machine 10 may be permitted only when the condition that the machine 10 is traveling forward at low speed has been met, as in the first embodiment of FIGS. 1-12. In this case, steps ST02-ST06 of FIG. 7 may be added between steps ST101 and ST102 of FIG. 14. At step ST106, the left rolling flag FLro and right rolling FRro are each set at "0" and the left turning flag FLtu and right turning FRtu are each set at "0", after which then the control section 61 proceeds to the output-connector B2.

Obviously, various minor changes and modifications of the present invention are possible in the light of the above teaching. It is therefore to be understood that within the scope of the appended claims the invention may be practiced otherwise than as specifically described.

What is claimed is:

1. A snow removing machine comprising:

left and right running devices mounted on a running-device frame;

an auger housing having an auger housed therein and rollably mounted on the running-device frame;

a rolling drive mechanism for rolling said auger housing;

a turning operator operable to turn said snow removing machine; and a control section for, in response to operation of said turning operator, performing control to drive said left and right running devices to thereby turn said snow removing machine in a desired turning direction;

wherein, in response to the operation of said turning operator, said control section also issues a drive instruction to said rolling drive mechanism to roll said auger housing in an inward direction, as viewed in the turning direction of the snow removing machine, such that a portion of one of side edges of said auger housing, located inwardly of the other of the side edges of said auger housing as viewed in the turning direction, is brought into contact with a ground surface.

2. A snow removing machine according to claim 1; further comprising left and right operating handles extending from a rear portion of the running-device frame; and wherein said turning operator comprises left and right operation levers operable by respective hands of a human operator holding said left and right operating handles, or left and right push-button switches provided between said left and right operating handles at positions within ranges operable by the hands of the human operator holding said left and right operating handles.

3. A snow removing machine according to claim 1; further comprising an auger-housing-posture manipulating lever operable to operate said rolling drive mechanism in order to roll said auger housing in accordance with a snow surface during a snow removal operation using the auger; and wherein said auger-housing-posture manipulating lever is arranged to also function as said turning operator.

4. A snow removing machine comprising:

a frame;

a pair of transporting devices mounted on the frame for transporting the snow removing machine on a ground surface;

a transmission mechanism having a rotation shaft extending in a forward/rearward direction of the snow removing machine;

an auger housing having an auger housed therein and mounted on the frame for undergoing rolling movement;

a rolling drive mechanism coupled to the auger housing for providing rolling movement of the auger housing relative to the frame and about the rotation shaft of the transmission mechanism;

a turning mechanism operable to turn the snow removing machine in a preselected direction; and a control section for, in response to operation of the turning mechanism, performing a control operation to drive the transporting devices to thereby turn the snow removing machine in the preselected direction and controlling operation of the rolling drive mechanism to provide rolling movement of the auger housing relative to the frame.

5. A snow removing machine according to claim 4; wherein the auger housing has a pair of lower end portions; and wherein the control section controls operation of the rolling drive mechanism to roll the auger housing relative to the frame so that one of the lower end portions of the auger housing is brought into contact with the ground surface.

6. A snow removing machine according to claim 4; further comprising a pair of operating handles mounted on the frame for operation by an operator of the snow removing machine; and wherein the turning mechanism comprises a pair of operation levers operable by respective hands of the operator during operation of the operating handles.

7. A snow removing machine according to claim 4; further comprising a pair of operating handles mounted on the frame for operation by an operator of the snow removing machine; and wherein the turning mechanism comprises a pair of operation switches disposed between the operating handles at positions within ranges operable by the operator during operation of the operation handles.

8. A snow removing machine according to claim 4; further comprising an operating member operable by an operator of the snow removing machine to operate the rolling drive mechanism to roll the auger housing relative to the frame during a snow removal operation.

9. A snow removing machine according to claim 8; wherein the operating member is configured to function as the turning mechanism for turning the snow removing machine in the preselected direction.

10. A snow removing machine according to claim 4; wherein the rolling drive mechanism comprises a hydraulic cylinder connected at one end to the frame and connected at the other end to the auger housing.

11. A snow removing machine comprising:

a frame;

a pair of transporting devices mounted on the frame to transport the snow removing machine on a ground surface during a snow removing operation;

an auger housing mounted on the frame to undergo rolling movement, the auger housing having an auger housed therein and first and second side edges;

a rolling drive mechanism coupled to the auger housing for providing rolling movement of the auger housing relative to the frame;

a turning mechanism operable by an operator of the snow removing machine to turn the snow removing machine in a preselected turning direction; and a control section that controls operation of the turning mechanism to turn the snow removing machine in the preselected direction and that controls operation of the rolling drive mechanism in response to operation of the turning mechanism to enable rolling movement of the auger housing relative to the frame to bring a portion of the first side edge, located inwardly of the second side edge as viewed in the turning direction, into contact with the ground surface to generate a moving resistance against the first side edge so that the snow removing machine can turn about the portion of the first side edge as a pivot center.

12. A snow removing machine according to claim 11; further comprising a pair of operating handles mounted on the frame for operation by the operator of the snow removing machine; and wherein the turning mechanism comprises a pair of operation levers operable by respective hands of the operator during operation of the operating handles.

13. A snow removing machine according to claim 11; further comprising a pair of operating handles mounted on the frame for operation by the operator of the snow removing machine; and wherein the turning mechanism comprises a pair of operation switches disposed between the operating handles at positions within ranges operable by the operator during operation of the operation handles.

14. A snow removing machine according to claim 11; further comprising an operating member operable by the operator of the snow removing machine to operate the rolling drive mechanism to roll the auger housing relative to the frame.

15. A snow removing machine according to claim 14; wherein the operating member is configured to function as the turning mechanism for turning the snow removing machine in the preselected direction.

16. A snow removing machine according to claim 11; wherein the rolling drive mechanism comprises a hydraulic cylinder connected at one end to the frame and connected at the other end to the auger housing.

17. A snow removing machine according to claim 11; further comprising a transmission mechanism having a rotation shaft extending in a forward/rearward direction of the snow removing machine; and wherein the auger housing undergoes rolling movement about the rotation shaft.

18. A snow removing machine according to claim 11; further comprising a transmission mechanism having a rotation shaft; and wherein the auger housing undergoes rolling movement about the rotation shaft in clockwise and counterclockwise directions as viewed by the operator of the snow removing machine during operation thereof.

* * * * *